US012440732B2

(12) United States Patent
Penney et al.

(10) Patent No.: US 12,440,732 B2
(45) **Date of Patent: *Oct. 14, 2025**

(54) GOLF CLUB HEAD

(71) Applicant: Taylor Made Golf Company, Inc., Carlsbad, CA (US)

(72) Inventors: Michelle Penney, Carlsbad, CA (US); David Bennett, Carlsbad, CA (US); Nathan T. Sargent, Oceanside, CA (US); Robert Story, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 283 days.

This patent is subject to a terminal disclaimer.

(21) Appl. No.: 18/135,502

(22) Filed: Apr. 17, 2023

(65) Prior Publication Data

US 2023/0321499 A1 Oct. 12, 2023

Related U.S. Application Data

(63) Continuation of application No. 17/198,030, filed on Mar. 10, 2021, now Pat. No. 11,654,336, which is a continuation of application No. 16/865,191, filed on May 1, 2020, now Pat. No. 10,974,102, which is a continuation of application No. 15/859,071, filed on Dec. 29, 2017, now Pat. No. 10,639,524, which is a continuation-in-part of application No. 15/617,919, (Continued)

(51) Int. Cl.

| | |
|---|---|
| ***A63B 53/02*** | (2015.01) |
| ***A63B 53/04*** | (2015.01) |
| ***A63B 53/06*** | (2015.01) |
| ***A63B 60/52*** | (2015.01) |

(52) U.S. Cl.

CPC ..... *A63B 53/02* (2013.01); *A63B 53/04* (2013.01); *A63B 53/0466* (2013.01); *A63B 53/06* (2013.01); *A63B 60/52* (2015.10); *A63B 53/023* (2020.08); *A63B 53/0408* (2020.08); *A63B 53/0412* (2020.08); *A63B 53/0416* (2020.08); *A63B 53/0433* (2020.08); *A63B 53/045* (2020.08); *A63B 2053/0491* (2013.01); *A63B 2209/00* (2013.01); *A63B 2225/01* (2013.01)

(58) Field of Classification Search

CPC ..... A63B 53/02; A63B 53/06; A63B 60/52; A63B 53/0466; A63B 53/04; A63B 2225/01; A63B 2053/0491; A63B 53/023; A63B 53/045; A63B 53/0408; A63B 53/0412; A63B 53/0416; A63B 53/0433

USPC ..... 473/324–350, 287–292

See application file for complete search history.

(56) References Cited

U.S. PATENT DOCUMENTS

| | | | |
|---|---|---|---|
| 5,518,243 | A | 5/1996 | Redman |
| 5,720,674 | A | 2/1998 | Galy |

(Continued)

*Primary Examiner* — Sebastiano Passaniti

(74) *Attorney, Agent, or Firm* — Klarquist Sparkman, LLP

(57) ABSTRACT

Disclosed golf club heads include a body defining an interior cavity, a face, a sole, a crown, a skirt, and a hosel. Some embodiments include one or more of a split mass pad and/or one or more weight ports positioned in a sole portion of the body. Additionally or alternatively, one or more mass pads or weight ports may be positioned adjacent to the periphery of the sole portion. Some embodiments further include an adjustable head-shaft connection assembly configured to adjustably couple the hosel to a golf club shaft.

17 Claims, 17 Drawing Sheets

Related U.S. Application Data filed on Jun. 8, 2017, now Pat. No. 10,478,679, which is a continuation of application No. 14/871,789, filed on Sep. 30, 2015, now Pat. No. 9,700,763, which is a continuation of application No. 14/701,476, filed on Apr. 30, 2015, now Pat. No. 9,211,447, which is a continuation of application No. 14/495,795, filed on Sep. 24, 2014, now Pat. No. 9,186,560, which is a continuation of application No. 13/828,675, filed on Mar. 14, 2013, now Pat. No. 8,888,607, which is a continuation-in-part of application No. 13/469,031, filed on May 10, 2012, now Pat. No. 9,220,953, which is a continuation-in-part of application No. 13/338,197, filed on Dec. 27, 2011, now Pat. No. 8,900,069.

(60) Provisional application No. 62/440,886, filed on Dec. 30, 2016, provisional application No. 61/427,772, filed on Dec. 28, 2010.

(56) References Cited

U.S. PATENT DOCUMENTS 6,123,627 A 9/2000 Antonious
6,371,868 B1 * 4/2002 Galloway ..... A63B 60/00 473/324
6,440,009 B1 8/2002 Guibaud et al.
6,604,568 B2 * 8/2003 Bliss ..... A63B 53/04 164/76.1
6,623,378 B2 9/2003 Beach et al.
7,530,903 B2 * 5/2009 Imamoto ..... A63B 60/02 473/335
7,749,101 B2 7/2010 Imamoto et al.
7,753,806 B2 7/2010 Beach et al.
7,758,452 B2 7/2010 Soracco
7,854,364 B2 12/2010 DeShiell et al.
7,854,667 B2 * 12/2010 Gillig ..... A63B 53/0466 473/345
8,684,863 B2 4/2014 Bezilla et al.
8,821,312 B2 9/2014 Burnett et al.
8,827,831 B2 9/2014 Burnett et al.
9,072,949 B2 7/2015 Stites et al.
9,095,753 B2 8/2015 Bezilla et al.
9,205,312 B2 12/2015 Zimmerman et al.
9,381,410 B2 7/2016 Golden et al.
9,700,771 B2 7/2017 Murphy et al.
9,901,794 B2 2/2018 Beno et al.
9,914,028 B1 3/2018 Cleghorn et al.
10,035,051 B2 7/2018 Cleghorn et al.
10,173,111 B2 1/2019 Busch et al.
10,463,928 B2 11/2019 Stokke et al.
10,898,764 B2 1/2021 Harbert et al.
10,905,929 B2 2/2021 Mata et al.
10,974,109 B2 4/2021 Stokke et al.
11,298,599 B2 4/2022 Mata et al.
11,628,340 B2 4/2023 Beach et al.
11,654,336 B2 * 5/2023 Penney ..... A63B 60/52 473/307
2003/0036442 A1 * 2/2003 Chao ..... A63B 53/0466 473/345
2003/0083145 A1 * 5/2003 Tsurumaki ..... A63B 53/04 473/305
2007/0049400 A1 3/2007 Imamoto et al.
2008/0119302 A1 * 5/2008 Bennett ..... A63B 60/42 473/335
2008/0153625 A1 6/2008 Morales et al.
2009/0170632 A1 * 7/2009 Beach ..... A63B 53/0466 473/335
2009/0239676 A1 * 9/2009 Bennett ..... A63B 53/047 473/307
2009/0286619 A1 11/2009 Beach et al.
2010/0075774 A1 3/2010 Ban
2010/0144461 A1 6/2010 Ban
2010/0167837 A1 7/2010 Ban
2010/0197426 A1 * 8/2010 De La Cruz ..... A63B 53/04 473/345
2012/0083359 A1 4/2012 Stites
2012/0202615 A1 * 8/2012 Beach ..... A63B 60/52 473/345
2015/0065265 A1 * 3/2015 Motokawa ..... A63B 53/04 473/335
2015/0297961 A1 * 10/2015 Voshall ..... A63B 53/06 473/335
2016/0001146 A1 1/2016 Sargent et al.
2022/0266102 A1 8/2022 Mata et al.
2023/0405411 A1 12/2023 Harbert et al.
2024/0139592 A1 5/2024 Mata et al.

* cited by examiner

Data COR Feature Length vs First Mode Frequency

| COR feature length (mm) | V6 Hz | V5 Hz |
|---|---|---|
| 64 | 3600 | 3650 |
| 65 | 3500 | 3580 |
| 73 | 3050 | 3300 |
| 77 | 2750 | 3050 |

GOLF CLUB HEAD

CROSS REFERENCE TO RELATED APPLICATIONS

This application is a continuation of U.S. patent application Ser. No. 17/198,030, filed Mar. 10, 2021, now U.S. Pat. No. 11,654,336, which is a continuation of U.S. patent application Ser. No. 16/865,191, filed May 1, 2020, now U.S. Pat. No. 10,974,102, which is a continuation of U.S. patent application Ser. No. 15/859,071, filed Dec. 29, 2017, now U.S. Pat. No. 10,639,524, which is a continuation-in-part of U.S. patent application Ser. No. 15/617,919, filed Jun. 8, 2017, now U.S. Pat. No. 10,478,679, which is a continuation of U.S. patent application Ser. No. 14/871,789, filed Sep. 30, 2015, now U.S. Pat. No. 9,700,763, which is a continuation of U.S. patent application Ser. No. 14/701,476, filed Apr. 30, 2015, now U.S. Pat. No. 9,211,447, which is a continuation of U.S. patent application Ser. No. 14/495,795, filed Sep. 24, 2014, now U.S. Pat. No. 9,186,560, which is a continuation of U.S. patent application Ser. No. 13/828,675, filed Mar. 14, 2013, now U.S. Pat. No. 8,888,607, which is a continuation-in-part of U.S. patent application Ser. No. 13/469,031, filed May 10, 2012, now U.S. Pat. No. 9,220,953, which is a continuation-in-part of U.S. patent application Ser. No. 13/338,197, filed Dec. 27, 2011, now U.S. Pat. No. 8,900,069, which claims the benefit of U.S. Provisional Patent Application No. 61/427,772, filed Dec. 28, 2010. U.S. patent application Ser. No. 15/859,071 further claims the benefit of U.S. Provisional Patent Application No. 62/440,886, filed Dec. 30, 2016. The prior applications are incorporated herein by reference in their entirety.

FIELD

The present application concerns golf club heads, and more particularly, golf club heads for fairway woods and other wood-type clubs.

INCORPORATIONS BY REFERENCE

Other patents and patent applications concerning golf clubs, such as U.S. Pat. Nos. 7,407,447, 7,419,441, 7,513,296, 7,753,806, 7,887,434, 8,118,689, and 8,888,607; U.S. Pat. Appl. Pub. Nos. 2004/0235584, 2005/0239575, 2010/0197424, and 2011/0312347; U.S. patent application Ser. Nos. 11/642,310, 11/648,013, and 13/401,690; and U.S. Prov. Pat. Appl. Nos. 60/877,336 and 61/009,743 are incorporated herein by reference in their entireties.

BACKGROUND

Much of the recent improvement activity in the field of golf has involved the use of new and increasingly more sophisticated materials in concert with advanced club-head engineering. For example, modern "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods" since they tend to be made primarily of strong, lightweight metals, such as titanium.

An exemplary metalwood golf club such as a driver or fairway wood typically includes a hollow shaft having a lower end to which the golf club head is attached. Most modern versions of these golf club heads are made, at least in part, of a lightweight but strong metal such as titanium alloy. In many cases, the golf club head comprises a body made primarily of such strong metals.

Some current approaches to reducing structural mass of a metalwood club-head are directed to making one or more portions of the golf club head of an alternative material. Whereas the bodies and face plates of most current metalwoods are made of titanium alloys, some golf club heads are made, at least in part, of components formed from either graphite/epoxy-composite (or other suitable composite material) and a metal alloy. Graphite composites have a much lower density compared to titanium alloys, which offers an opportunity to provide more discretionary mass in the club-head.

The ability to utilize such materials to increase the discretionary mass available for placement at various points in the club-head allows for optimization of a number of physical properties of the club-head which can greatly impact the performance obtained by the user. Forgiveness on a golf shot is generally maximized by configuring the golf club head such that the center of gravity ("CG") of the golf club head is optimally located and the moment of inertia ("MOI") of the golf club head is maximized. CG and MOI can also critically affect a golf club head's performance, such as launch angle and flight trajectory on impact with a golf ball, among other characteristics.

In addition to the use of various materials to optimize the strength-to-weight properties and acoustic properties of the golf club heads, advances have been made in the mass distribution properties provided by using thicker and thinner regions of materials, raising and lowering certain portions of the sole and crown, providing adjustable weight members and adjustable head-shaft connection assemblies, and many other golf club head engineering advances.

SUMMARY

This application discloses, among other innovations, fairway wood-type golf club heads that provide, among other attributes, improved forgiveness, ball speed, adjustability and playability, while maintaining durability.

The following describes wood-type golf club heads that include a body defining an interior cavity, a sole portion positioned at a bottom portion of the golf club head, a crown portion positioned at a top portion, and a skirt portion positioned around a periphery between the sole and crown. The body also has a face defining a forward portion extending between a heel portion of the golf club head and a toe portion of the golf club head, a rearward portion opposite the face, and a hosel.

Certain of the described golf club heads have a channel, a slot, or other member that increases or enhances the perimeter flexibility of the striking face of the golf club head in order to increase the coefficient of restitution and/or characteristic time of the golf club head and frees up additional discretionary mass which can be utilized elsewhere in the golf club head. In some instances, the channel, slot, or other mechanism is located in the forward portion of the sole of the golf club head, adjacent to or near to the forwardmost edge of the sole. Also, in some instances, the channel extends into the interior cavity of the golf club head, the channel extending substantially in a heel-toe direction.

Further, certain of the described golf club heads have a plurality of areas of concentrated mass, which may in some cases may be positioned to affect various performance characteristics of the club, and in some cases may be removable by the user to further tune various aspects of the golf club head's performance.

The concentrated mass in one instance may comprise a mass pad positioned on an interior of the sole rearward of and adjacent to the channel. In certain instances, this forward mass pad has a plurality of integral mass sections, such as a heel mass section, a toe mass section, and a middle mass section positioned between the heel mass section and the toe mass section. In particular instances, each of the heel and toe mass sections has a mass that is greater than the mass of the middle mass section, and a forward to rearward dimension that is greater than a forward to rearward dimension of the middle mass section. In particular instances, the toe mass section and the heel mass section each has a mass between about 10 grams and about 40 grams, and the middle mass section has a mass between about 5 grams and about 15 grams. In some instances, a weight port may be positioned behind the middle mass section for securing and at least partially retaining a removable weight. The removable weight may vary in mass, as selected by a user. In particular instances at least one removable weight having a mass between about 0.5 grams to about 30 grams, or from about 0.5 grams to about 20 grams, or from about 2 grams to about 18 grams is provided, the at least one removable weight configured to be installed at least partially within the weight port. In other cases, a void may be provided behind the middle mass section, so that mass may be distributed elsewhere within the golf club head.

In addition to the forward mass pad, in some of the described golf club heads, a second, rearward mass pad is positioned at or near the periphery of the club in the rearward portion of the club. In some cases, the rearward mass pad is positioned in the heel portion of the rearward portion of the golf club head. In some instances, the rearward mass pad has a mass between about 10 grams and about 40 grams, or between about 10 grams and about 30 grams, or between about 5 grams and about 15 grams.

Certain of the described golf club heads have either one (as described above), or a plurality of weight ports in which removable weights selectable by a user may be at least partially retained. In certain instances, a first plurality of weight ports is positioned in the sole of the golf club head rearward of and adjacent to the channel and a second plurality of weight ports in addition to the first plurality of weight ports is positioned in the sole of the golf club head adjacent the skirt portion. In particular cases, one or more of the second plurality of weight ports is positioned rearward of the channel. In particular cases, two of the second plurality of weight ports are positioned in: a) the toe portion and the rearward portion of the golf club head, b) the heel portion and the rearward portion of the golf club head, and/or c) the toe portion and the heel portion of the golf club head. In particular instances, the first plurality of weight ports comprises three weight ports. In particular instances, the second plurality of weight ports comprises at least three weight ports. Additionally, in some instances the golf club head comprises a plurality of rib sections, each extending between one of the first plurality of weight ports and a corresponding one of the second plurality of weight ports. In some instances, the golf club head further comprises an adjustable head-shaft connection assembly configured to adjustably couple the hosel to a golf club shaft.

In some instances, golf club heads disclosed herein have one or more of the following features, alone or in combination:

- a height less than about 46 mm;
- a volume of between about 125 and 250 $cm^3$;
- a moment of inertia about an x axis (Ixx) greater than about 70 to 220 kg-$mm^2$;
- a moment of inertia about a z axis (Izz), greater than about 170 to 375 kg-$mm^2$;
- an above ground center-of-gravity location, Zup, that is less than about 13.5 to 18 mm; and
- a center of gravity located horizontally rearward of a center of the face of the golf club head of less than about 10 to 40 mm.

The foregoing and other objects, features, and advantages of the invention will become more apparent from the following detailed description, which proceeds with reference to the accompanying figures.

DETAILED DESCRIPTION

The following describes embodiments of golf club heads for metalwood type golf clubs, including drivers, fairway woods, rescue clubs, hybrid clubs, and the like. Several of the golf club heads incorporate features that provide the golf club heads and/or golf clubs with increased moments of inertia and low centers of gravity, centers of gravity located in preferable locations, improved golf club head and face geometries, increased sole and lower face flexibility, higher coefficients or restitution ("COR") and characteristic times ("CT"), and/or decreased backspin rates relative to fairway wood and other golf club heads that have come before.

This disclosure describes embodiments of golf club heads in the context of fairway wood-type golf clubs, but the principles, methods and designs described may be applicable in whole or in part to other wood-type golf clubs, such as drivers, utility clubs (also known as hybrid clubs), rescue clubs, and the like.

The disclosed inventive features include all novel and non-obvious features disclosed herein, both alone and in novel and non-obvious combinations with other elements. As used herein, the phrase "and/or" means "and," "or" and both "and" and "or." As used herein, the singular forms "a," "an" and "the" refer to one or more than one, unless the context clearly dictates otherwise. As used herein, the terms "including" and "having" (and their grammatical variants) mean "comprising."

This disclosure also refers to the accompanying drawings, which form a part hereof. The drawings illustrate specific embodiments, but other embodiments may be formed and structural changes may be made without departing from the intended scope of this disclosure and the technology discussed herein. Directions and references (e.g., up, down, top, bottom, left, right, rearward, forward, heelward, toeward, etc.) may be used to facilitate discussion of the drawings but are not intended to be limiting. For example, certain terms may be used such as "up," "down," "upper," "lower," "horizontal," "vertical," "left," "right" and the like. These terms are used where applicable, to provide some clarity of description when dealing with relative relationships, particularly with respect to the illustrated embodiments. Such terms are not, however, intended to imply absolute relationships, positions and/or orientations, unless otherwise indicated. For example, with respect to an object, an "upper" surface can become a "lower" surface simply by turning the object over. Nevertheless, it is still the same object. Accordingly, the following detailed description shall not be construed in a limiting sense and the scope of property rights sought shall be defined by the appended claims and their equivalents.

Figure 9:
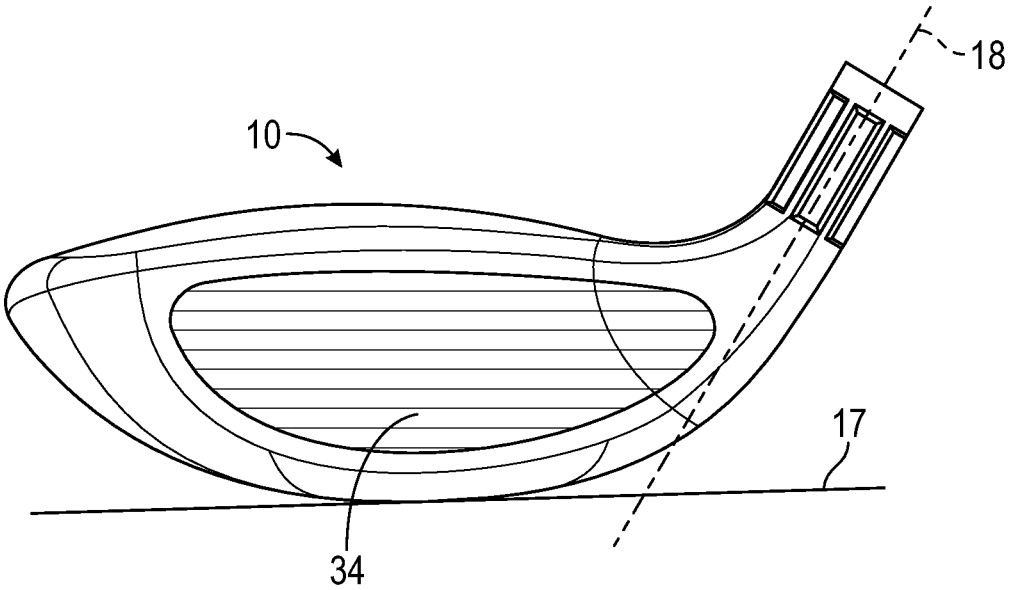
FIG. 9 is a front elevational view of the golf club head of FIG. 1.
Figure 10:
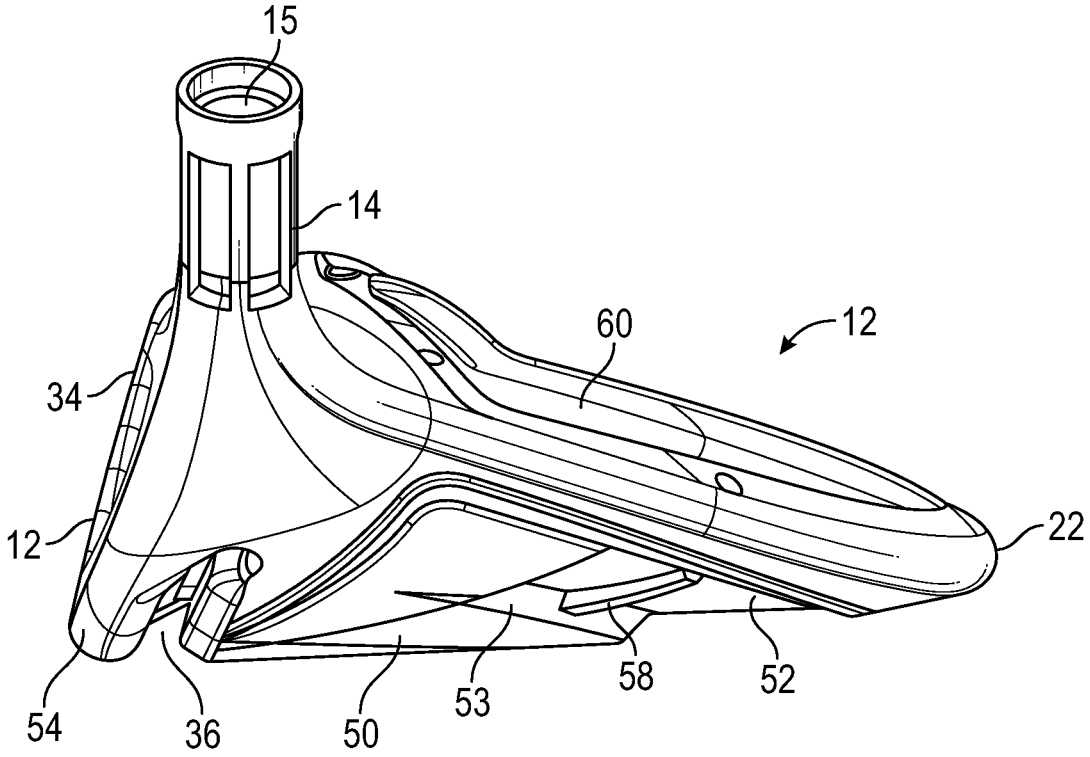
FIG. 10 is a heel-side view of the body of FIG. 4.

Golf club heads and many of their physical characteristics disclosed herein will be described using "normal address position" as the golf club head reference position, unless otherwise indicated. FIG. 9 illustrates one embodiment of a fairway wood type golf club head at normal address position. At normal address position, the golf club head 10 rests on a ground plane 17, a plane parallel to the ground.

As used herein, "normal address position" means the golf club head position wherein a vector normal to the face plate 34 substantially lies in a first vertical plane (i.e., a vertical plane is perpendicular to the ground plane 17, a centerline axis 18 of a club shaft substantially lies in a second vertical plane, and the first vertical plane and the second vertical plane intersect.

Golf club head "forgiveness" generally describes the ability of a golf club head to deliver a desirable golf ball trajectory despite a mis-hit (e.g., a ball struck at a location on the face plate 34 other than an ideal impact location). As described above, large mass moments of inertia contribute to the overall forgiveness of a golf club head. In addition, a low center-of-gravity improves forgiveness for golf club heads used to strike a ball from the turf by giving a higher launch angle and a lower spin trajectory (which improves the distance of a fairway wood golf shot). Providing a rearward center-of-gravity reduces the likelihood of a slice or fade for many golfers. Accordingly, forgiveness of fairway wood golf club heads, can be improved using the techniques described above to achieve high moments of inertia and low center-of-gravity compared to conventional fairway wood golf club heads.

For example, a golf club head with a crown thickness less than about 0.65 mm throughout at least about 70% of the crown can provide significant discretionary mass. A 0.60 mm thick crown can provide as much as about 8 grams of discretionary mass compared to a 0.80 mm thick crown. The large discretionary mass can be distributed to improve the mass moments of inertia and desirably locate the golf club head center-of-gravity. Generally, discretionary mass should be located sole-ward rather than crown-ward to maintain a low center-of-gravity, forward rather than rearward to maintain a forwardly positioned center of gravity, and rearward rather than forward to maintain a rearwardly positioned center-of-gravity. In addition, discretionary mass should be located far from the center-of-gravity and near the perimeter of the golf club head to maintain high mass moments of inertia.

Another parameter that contributes to the forgiveness and successful playability and desirable performance of a golf club is the coefficient of restitution (COR) of the golf club head. Upon impact with a golf ball, the golf club head's face plate deflects and rebounds, thereby imparting energy to the struck golf ball. The golf club head's coefficient of restitution (COR) is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. In order to maximize the moment of inertia (MOI) about the center of gravity (CG) and achieve a high COR, it typically is desirable to incorporate thin walls and a thin face plate into the design of the golf club head. Thin walls afford the designers additional leeway in distributing golf club head mass to achieve desired mass distribution, and a thinner face plate may provide for a relatively higher COR.

Thus, thin walls are important to a club's performance. However, overly thin walls can adversely affect the golf club head's durability. Problems also arise from stresses distributed across the golf club head upon impact with the golf ball, particularly at junctions of golf club head components, such as the junction of the face plate with other golf club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the golf club head. Thus, these golf club heads fail to provide optimal MOI, CG, and/or COR parameters, and as a result, fail to provide much forgiveness for off-center hits for all but the most expert golfers.

Thus, the golf clubs head of this disclosure are designed to allow for introduction of a face which can be adjusted in thickness as needed or desired to interact with the other disclosed aspects, such as a hollow front speed channel behind the face, as well as increased areas of mass and/or removable weights. The golf club heads of this disclosure may utilize, for example, the variable thickness face features described in U.S. patent application Ser. No. 12/006,060, U.S. Pat. Nos. 6,997,820, 6,800,038, and 6,824,475, which are incorporated herein by reference in their entirety. Additionally, the mass of the face, as well as other of the above-described properties can be adjusted by using different face materials, structures, and features, such as those described in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety. Additionally, the structure of the front channel, club head face, and surrounding features of any of the embodiments herein can be varied to further impact COR and related aspects of the golf club head performance, as further described in U.S. patent application Ser. Nos. 13/839,727 and 14/457,883, which are incorporated by reference herein in their entirety.

In addition to the thickness of the face plate and the walls of the golf club head, the location of the center of gravity also has a significant effect on the COR of a golf club head. For example, a given golf club head having a given CG will have a projected center of gravity or "balance point" or "CG projection" that is determined by an imaginary line passing through the CG and oriented normal to the face plate 34. The location where the imaginary line intersects the face plate 34 is the CG projection, which is typically expressed as a distance above or below the center of the face plate 34. When the CG projection is well above the center of the face, impact efficiency, which is measured by COR, is not maximized. It has been discovered that a fairway wood with a relatively lower CG projection or a CG projection located at or near the ideal impact location on the striking surface of the club face, as described more fully below, improves the impact efficiency of the golf club head as well as initial ball speed. One important ball launch parameter, namely ball spin, is also improved.

Fairway wood shots typically involve impacts that occur below the center of the face, so ball speed and launch parameters are often less than ideal. This results because most fairway wood shots are from the ground and not from a tee, and most golfers have a tendency to hit their fairway wood ground shots low on the face of the golf club head. Maximum ball speed is typically achieved when the ball is struck at the location on the striking face where the COR is greatest.

For traditionally designed fairway woods, the location where the COR is greatest is the same as the location of the CG projection on the striking surface. This location, however, is generally higher on the striking surface than the below center location of typical ball impacts during play. In contrast to these conventional golf clubs, it has been discovered that greater shot distance is achieved by configuring the golf club head to have a CG projection that is located near to the center of the striking surface of the golf club head.

It is known that the coefficient of restitution (COR) of a golf club may be increased by increasing the height $H_{ss}$ of the face plate 34 and/or by decreasing the thickness of the face plate 34 of a golf club head. However, in the case of a fairway wood, hybrid, or rescue golf club, increasing the face height may be considered undesirable because doing so will potentially cause an undesirable change to the mass properties of the golf club (e.g., center of gravity location) and to the golf club's appearance.

The United States Golf Association (USGA) regulations constrain golf club head shapes, sizes, and moments of inertia. Due to theses constraints, golf club manufacturers and designers struggle to produce golf club heads having maximum size and moment of inertia characteristics while maintaining all other golf club head characteristics. For example, one such constraint is a volume limitation of 460 $cm^3$. In general, volume is measured using the water displacement method. However, the USGA will fill any significant cavities in the sole or series of cavities which have a collective volume of greater than 15 $cm^3$.

To produce a more forgiving golf club head designers struggle to maximize certain parameters such as face area, moment of inertia about the z-axis and x-axis, and address area. A larger face area makes the golf club head more forgiving. Likewise, higher moment of inertia about the z-axis and x-axis makes the golf club head more forgiving. Similarly, a larger front to back dimension will generally increase moment of inertia about the z-axis and x-axis because mass is moved further from the center of gravity and the moment of inertia of a mass about a given axis is proportional to the square of the distance of the mass away from the axis. Additionally, a larger front to back dimension will generally lead to a larger address area which inspires confidence in the golfer when s/he addresses the golf ball.

However, when designers seek to maximize the above parameters it becomes difficult to stay within the volume limits and golf club head mass targets. Additionally, the sole curvature begins to flatten as these parameters are maximized. A flat sole curvature provides poor acoustics. To counteract this problem, designers may add a significant amount of ribs to the internal cavity to stiffen the overall structure and/or thicken the sole material to stiffen the overall structure. See for example FIGS. 55C and 55D and the corresponding text of U.S. Publication No. 2016/0001146 A1, published Jan. 7, 2016. This, however, wastes discretionary mass that could be put elsewhere to improve other properties like moment of inertia about the z-axis and x-axis.

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

Figure 1:
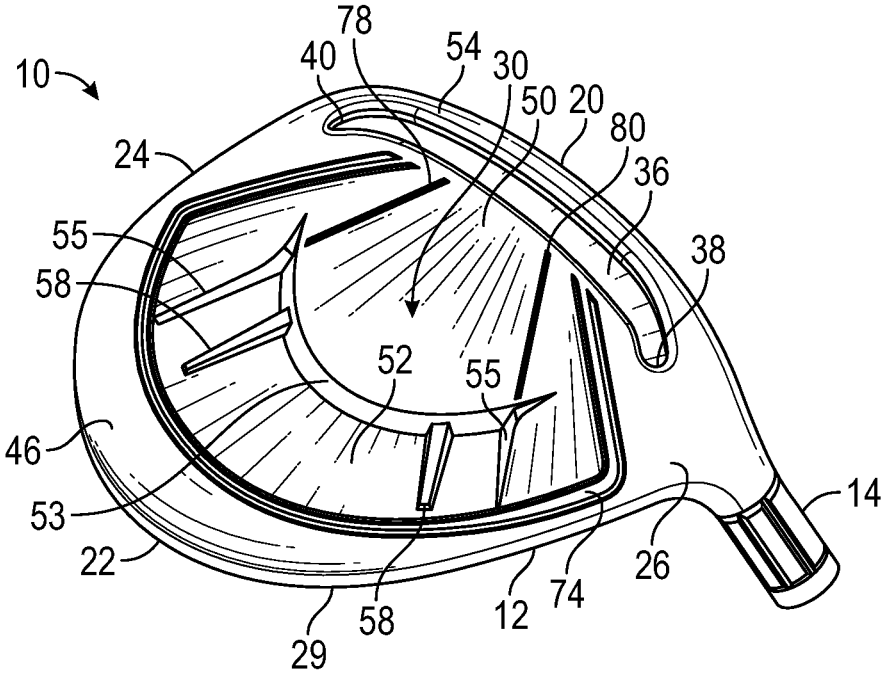
FIG. 1 is a bottom perspective view of an exemplary golf club head disclosed herein.

FIGS. 1-10 illustrate an exemplary golf club head 10 that embodies certain inventive technologies disclosed herein. This exemplary embodiment of a golf club head provides increased COR by increasing or enhancing the perimeter flexibility of a face plate 34 of the golf club without necessarily increasing the height or decreasing the thickness of the face plate 34. For example, FIG. 1 is a bottom perspective view of a golf club head 10 having a high COR. The golf club head 10 comprises a body 12 (shown isolated in FIGS. 4, 7A, and 10), a hosel 14 (illustrated in FIGS. 3 and 8A) comprising a hosel bore 15, in which a golf club shaft may be inserted and secured to the golf club head 10, and a crown insert 32 (see FIGS. 2 and 3) that is attached to the top of the body 12. The golf club head 10 defines a front end or face 20, rear end 22, toe side 24, heel side 26, lower side or sole 30, and upper side or crown 28 (all embodiments disclosed herein share similar directional references).

The front end 20 includes a face plate 34 (FIG. 2) for striking a golf ball, which may be an integral part of the body 12 or a separate insert. Though not shown, the front end 20 can include a face opening to receive a face plate 34 that is attached to the body by welding, braising, soldering, screws or other fastening means. A skirt portion 29 extends around the periphery of the club head between the sole 30 and crown 28 and excluding the face plate 34.

Figure 3:
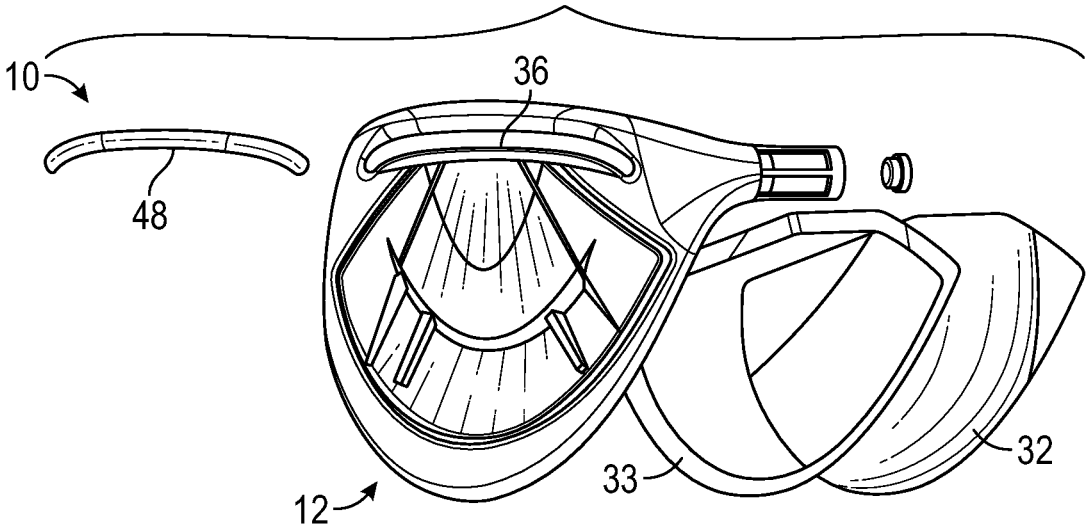
FIG. 3 is an exploded perspective view of the golf club head of FIG. 1.
Figure 6:
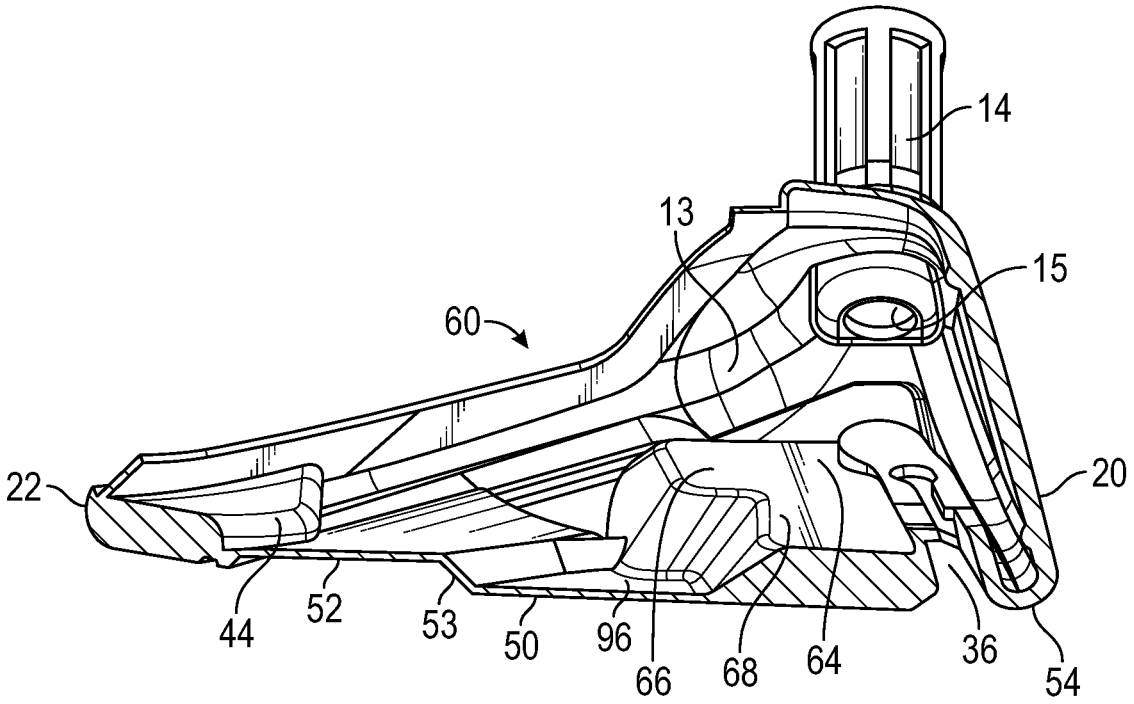
FIG. 6 is a cross-sectional view of a heel portion of the body of FIG. 4.

Near the face plate 34, a front channel 36 is formed in the sole 30. As illustrated in FIG. 6, the channel 36 extends into an interior cavity 13 of the golf club head 10, and so, as illustrated in FIG. 3, may be provided with a slot insert 48 to prevent dirt, grass, or other elements from entering the interior of the body 12. The front channel 36 extends in the toe-heel directions across the sole, with a heelward end 38 near the hosel 14 and an opposite toeward end 40. The front channel can improve coefficient of restitution (COR) across the striking face and can provide increased forgiveness on off-center ball strikes. For example, the presence of the front channel can expand zones of the highest COR across the face of the club, particularly at the bottom of the club face near the channel, so that a larger fraction of the face area has a COR above a desired value, especially at the lower regions of the face. More information regarding the construction and performance benefits of the front channel 36 and similar front channels can be found in U.S. Pat. No. 8,870,678 and U.S. Publication Nos. 2016/0059094 A1, published Mar. 3, 2016, 2016/0023060 A1, published Jan. 28, 2016, and 2016/0023063 A1, published Jan. 28, 2016, all of which are incorporated by reference herein in their entireties, and various of the other publications that are incorporated by reference herein.

Figure 4:
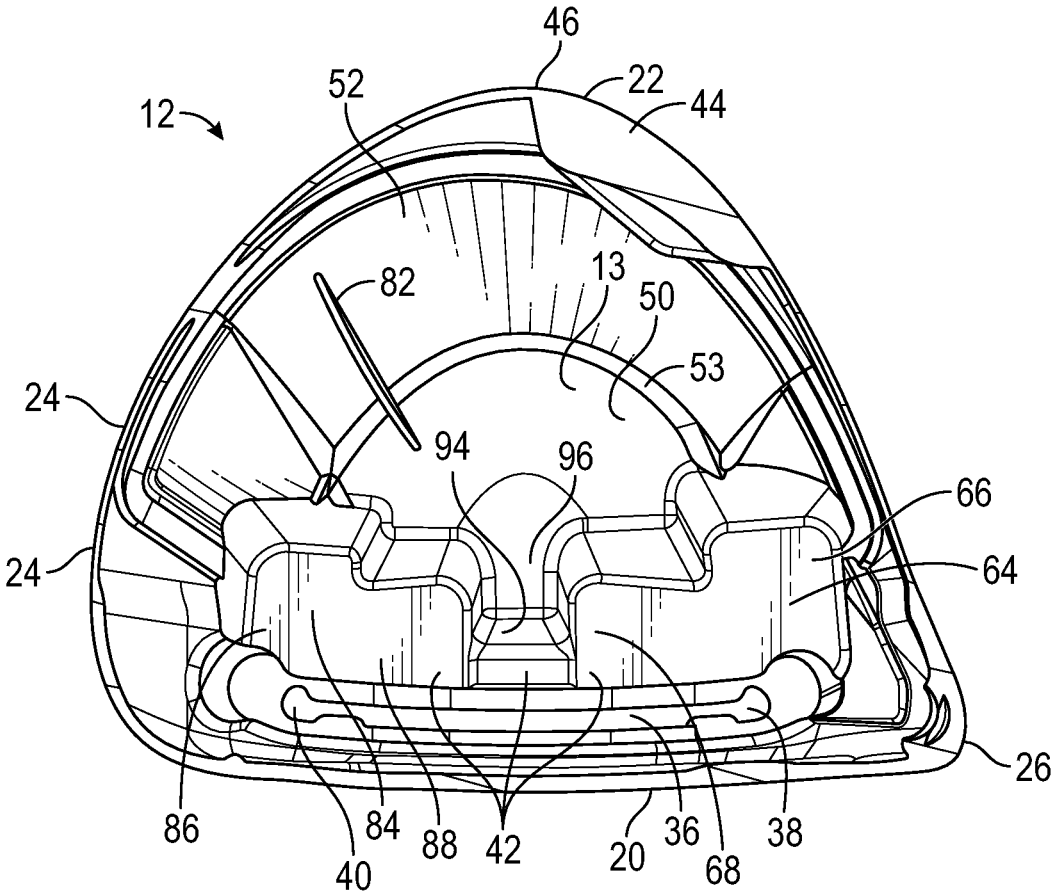
FIG. 4 is a top view of the body of the golf club head of FIG. 1.

As best illustrated in FIG. 4, a forward mass pad 42 is separated from and positioned rearward of the channel 36, and a second, rearward mass pad 44 is positioned near the rear sole surface 46 and formed integrally with the rear end 22 of the golf club head 10. Exemplary embodiments of the structure of the forward mass pad 42 are further described herein. In the illustrated embodiment, the rearward mass pad 44 is shown as being formed on the heel side 26 of the golf club head 10, though in other embodiments, it might be situated closer to the center of the rear end 22 of the golf club head 10, or even on the toe side 24, of the golf club head 10.

The body 12 can include a front ground contact surface 54 on the body forward of the front channel 36 adjacent the bottom of the face plate 34. The body can also have an intermediate ground contact surface, or sit pad, 50 rearward of the channel 36. The intermediate ground contact surface 50 can have an elevation and curvature congruent with that of the front ground contact surface 54. The body 12 can further comprise a downwardly extending rear sole surface 46 that extends around the perimeter of the rear end 22 of the body. In some embodiments, the rear sole surface 46 can act as a ground contact or sit pad as well, having a curvature and elevation congruent with that of the front ground contact surface 54 and the intermediate ground contact surface 50.

The body 12 can further include a raised sole portion 52 that is recessed up from the intermediate ground contact surface 50 and from the rear sole surface 46. The raised sole portion 52 can span over any portion of the sole 30, and in the illustrated embodiment the raised sole portion 52 spans over most of the rearward portion of the sole. The sole 30 can include a sloped transition portion 53 where the intermediate ground contact surface 50 transitions up to the raised sole portion 52. The sole can also include other similar sloped portions (not shown), such as around the boundary of the raised sole portion 52. In some embodiments, as illustrated, one or more cantilevered ribs or struts 58 can be included on the sole that span from the sloped transition portion 53 to the raised sole portion 52, to provide increased stiffness and rigidity to the sole.

Figure 7A:
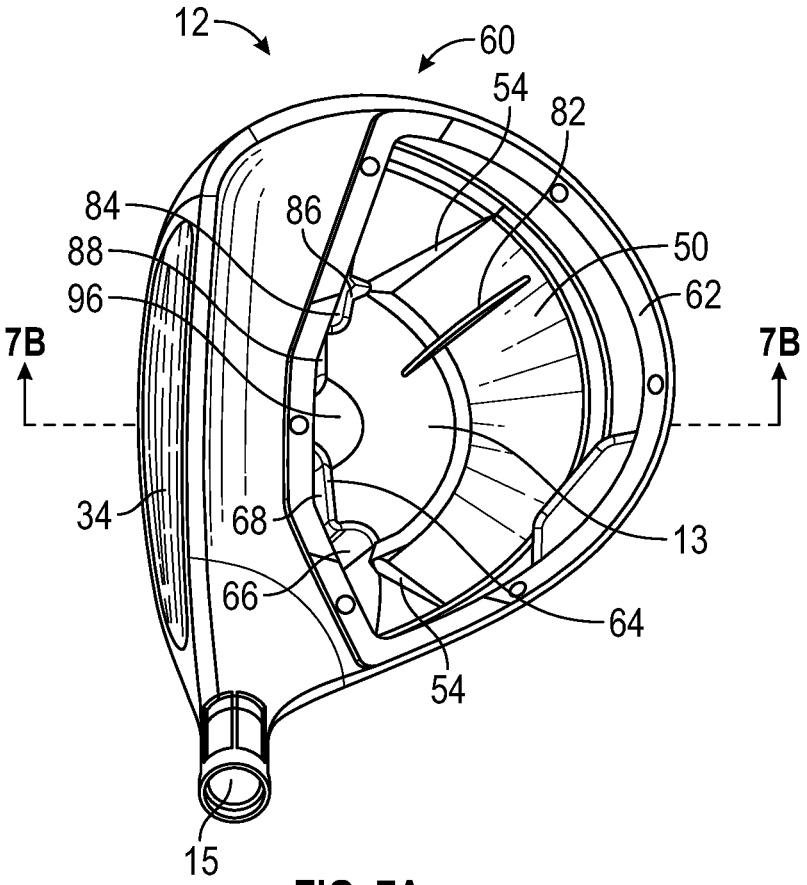
FIG. 7A is a top perspective view of the body of FIG. 4.
Figure 7B:
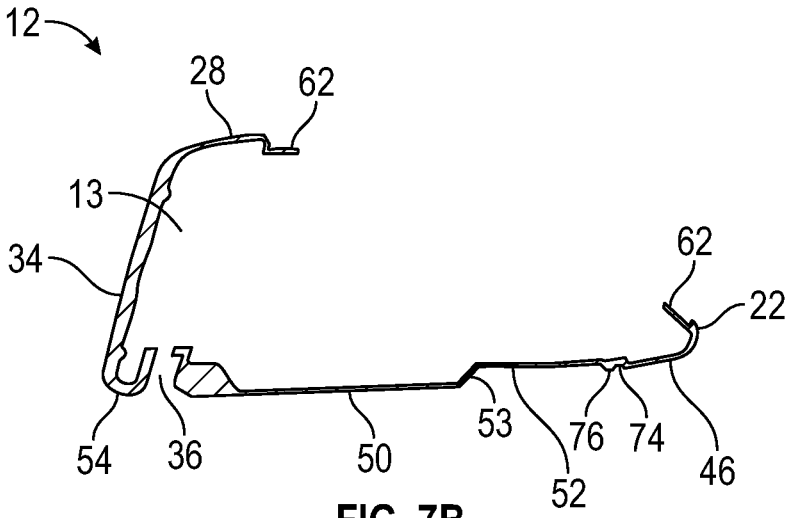
FIG. 7B is a cross-sectional view of the body of FIG. 4, taken along line 7B-7B in FIG. 7A.

The raised sole portion 52 can optionally include grooves, channels, ridges, or other surface features that increase its rigidity, such as groove 74 and ridge 76, best illustrated in FIG. 7B. Similarly, the intermediate ground contact surface 50 can include stiffening surface features, such as ridges 78 and 80, though grooves or other stiffening features can be substituted for the ridges.

A sole such as the sole 30 of the golf club head 10 may be referred to as a two-tier construction, bi-level construction, raised sole construction, or dropped sole construction, in which one portion of the sole is raised or recessed relative to the other portion of the sole. The terms raised, lowered, recessed, dropped, etc. are relative terms depending on perspective. For example, the intermediate ground contact surface 50 could be considered "raised" relative to the raised sole portion 52 when the head is upside down with the sole facing upwardly as in FIG. 1. On the other hand, the intermediate ground contact surface 50 portion can also be considered a "dropped sole" part of the sole, since it is located closer to the ground relative to the raised sole portion 52 when the golf club head is in a normal address position with the sole facing the ground.

Additional disclosure regarding the use of recessed or dropped soles is provided in U.S. Provisional Patent Application No. 62/515,401, filed on Jun. 5, 2017, the entire disclosure of which is incorporated herein by reference.

The raised sole constructions described herein and in the incorporated references are counterintuitive because the raised portion of the sole tends to raise the Iyy position), which is sometimes considered disadvantageous. However, the raised sole portion 52 (and other raised sole portion embodiments disclosed herein) allows for a smaller radius of curvature for that portion of the sole (compared to a conventional sole without the raised sole portion) resulting in increased rigidity and better acoustic properties due to the increased stiffness from the geometry. This stiffness increase means fewer ribs or even no ribs are needed in that portion of the sole to achieve a desired first mode frequency, such as 3000 Hz or above, 3200 Hz or above, or even 3400 Hz or above. Fewer ribs provides a mass/weight savings, which allows for more discretionary mass that can be strategically placed elsewhere in the golf club head or incorporated into user adjustable movable weights.

Furthermore, the sloped transition portions 53, 55 around the raised sole portion 52, as well as groove 74 and ridge 76, respectively, and the optional ribs, e.g., rib 58, can provide additional structural support and additional rigidity for the golf club head, and can also modify and even fine tune the acoustic properties of the golf club head. The sound and modal frequencies emitted by the golf club head when it strikes a golf ball are very important to the sensory experience of a golfer and provide functional feedback as to where the ball impact occurs on the face (and whether the ball is well struck).

In some embodiments, the raised sole portion 52 can be made of a relatively thinner and/or less dense material compared to other portions of the sole and body that take more stress, such as the ground contact surfaces 46, 54, 50, the face region, and the hosel region. By reducing the mass of the raised sole portion 52, the higher CG effect of raising that portion of the sole is mitigated while maintaining a stronger, heavier material on other portions of the sole and body to promote a lower CG and provide added strength in the area of the sole and body where it is most needed (e.g., in a sole region proximate to the hosel and around the face and shaft connection components where stress is higher).

The body 12 can also include one or more internal ribs, such as rib 82, as best shown in FIGS. 4 and 7A, that are integrally formed with or attached to the inner surfaces of the body. Such ribs can vary in size, shape, location, number and stiffness, and can be used strategically to reinforce or stiffen designated areas of the body's interior and/or fine tune acoustic properties of the golf club head.

Generally, the center of gravity (CG) of a golf club head is the average location of the weight of the golf club head or the point at which the entire weight of the golf club-head may be considered as concentrated so that if supported at this point the head would remain in equilibrium in any position. A golf club head origin coordinate system can be defined such that the location of various features of the golf club head, including the CG can be determined with respect to a golf club head origin positioned at the geometric center of the striking surface and when the club-head is at the normal address position (i.e., the club-head position wherein a vector normal to the club face substantially lies in a first vertical plane perpendicular to the ground plane, the centerline axis of the club shaft substantially lies in a second substantially vertical plane, and the first vertical plane and the second substantially vertical plane substantially perpendicularly intersect).

The head origin coordinate system defined with respect to the head origin includes three axes: a z-axis extending through the head origin in a generally vertical direction relative to the ground; an x-axis extending through the head origin in a toe-to-heel direction generally parallel to the striking surface (e.g., generally tangential to the striking surface at the center) and generally perpendicular to the z-axis; and a y-axis extending through the head origin in a front-to-back direction and generally perpendicular to the x-axis and to the z-axis. The x-axis and the y-axis both extend in generally horizontal directions relative to the ground when the golf club head is at the normal address position. The x-axis extends in a positive direction from the origin towards the heel of the golf club head. The y axis extends in a positive direction from the head origin towards the rear portion of the golf club head. The z-axis extends in a positive direction from the origin towards the crown. Thus for example, and using millimeters as the unit of measure, a CG that is located 3.2 mm from the head origin toward the toe of the golf club head along the x-axis, 36.7 mm from the head origin toward the rear of the clubhead along the y-axis, and 4.1 mm from the head origin toward the sole of the golf club head along the z-axis can be defined as having a $CG_x$ of −3.2 mm, a $CG_y$ of −36.7 mm, and a $CG_z$ of −4.1 mm.

Further as used herein, Delta 1 is a measure of how far rearward in the golf club head body the CG is located. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the golf club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can create a higher dynamic loft and more reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

Similarly Delta 2 is the distance between the CG and the hosel axis along the x axis (in the direction straight toward the back of the body of the golf club face from the geometric center of the striking face).

Adjusting the location of the discretionary mass in a golf club head as described herein can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

In addition to the position of the CG of a club-head with respect to the head origin another important property of a golf club-head is a projected CG point on the golf club head striking surface which is the point on the striking surface that intersects with a line that is normal to the tangent line of the ball striking club face and that passes through the CG. This projected CG point ("CG Proj") can also be referred to as the "zero-torque" point because it indicates the point on the ball striking club face that is centered with the CG. Thus, if a golf ball makes contact with the club face at the projected CG point, the golf club head will not twist about any axis of rotation since no torque is produced by the impact of the golf ball. A negative number for this property indicates that the projected CG point is below the geometric center of the face.

In terms of the MOI of the club-head (i.e., a resistance to twisting) it is typically measured about each of the three main axes of a club-head with the CG as the origin of the coordinate system. These three axes include a CG z-axis extending through the CG in a generally vertical direction relative to the ground when the golf club head is at normal address position; a CG x-axis extending through the CG origin in a toe-to-heel direction generally parallel to the striking surface (e.g., generally tangential to the striking surface at the club face center), and generally perpendicular to the CG z-axis; and a CG y-axis extending through the CG origin in a front-to-back direction and generally perpendicular to the CG x-axis and to the CG z-axis. The CG x-axis and the CG y-axis both extend in generally horizontal directions relative to the ground when the golf club head is at normal address position. The CG x-axis extends in a positive direction from the CG origin to the heel of the golf club head. The CG y-axis extends in a positive direction from the CG origin towards the rear portion of the golf club head. The CG z-axis extends in a positive direction from the CG origin towards the crown. Thus, the axes of the CG origin coordinate system are parallel to corresponding axes of the head origin coordinate system. In particular, the CG z-axis is parallel to z-axis, the CG x-axis is parallel to x-axis, and CG y-axis is parallel to y-axis.

Specifically, a golf club head as a moment of inertia about the vertical axis ("Izz"), a moment of inertia about the heel/toe axis ("Ixx"), and a moment of inertia about the front/back axis ("Iyy"). Typically, however, the MOI about the z-axis (Izz) and the x-axis (Ixx) is most relevant to golf club head forgiveness.

A moment of inertia about the golf club head CG x-axis (Ixx) is calculated by the following equation:

$$Ixx=\int(y^2+z^2)dm$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following equation:

$$Izz=\int(x^2+y^2)dm$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

A further description of the coordinate systems for determining CG positions and MOI can be found US Patent Publication No. 2012/0172146 A1, published on Jul. 5, 2012, the entire contents of which is incorporated by reference herein.

As used herein, "Zup" means the CG z-axis location determined according to the above ground coordinate system. Zup generally refers to the height of the CG above the ground plane 17.

As described herein, desired golf club head mass moments of inertia, golf club head center-of-gravity locations, and other mass properties of a golf club head can be attained by distributing golf club head mass to particular locations. Discretionary mass generally refers to the mass of material that can be removed from various structures providing mass that can be distributed elsewhere for tuning one or more mass moments of inertia and/or locating the golf club head center-of-gravity.

Golf club head walls provide one source of discretionary mass. In other words, a reduction in wall thickness reduces the wall mass and provides mass that can be distributed elsewhere. Thin walls, particularly a thin crown 28, provide significant discretionary mass compared to conventional golf club heads. For example, a golf club head made from an alloy of steel can achieve about 4 grams of discretionary mass for each 0.1 mm reduction in average crown thickness. Similarly, a golf club head made from an alloy of titanium can achieve about 2.5 grams of discretionary mass for each 0.1 mm reduction in average crown thickness. Discretionary mass achieved using a thin crown, e.g., less than about 0.65 mm, can be used to tune one or more mass moments of inertia and/or center-of-gravity location.

To achieve a thin wall on the golf club head body 10, such as a thin crown 28, a golf club head body 10 can be formed from an alloy of steel or an alloy of titanium. For further details concerning titanium casting, please refer to U.S. Pat. No. 7,513,296, incorporated herein by reference.

Various approaches can be used for positioning discretionary mass within a golf club head. For example, golf club heads may have one or more integral mass pads cast into the head at predetermined locations that can be used to lower, to move forward, to move rearward, or otherwise to adjust the location of the golf club head's center-of-gravity, as further described herein. Also, epoxy can be added to the interior of the golf club head, such as through a hosel bore 15 (illustrated in FIGS. 5, 6, 7A, 8A, and 8B) in the golf club head to obtain a desired weight distribution. Alternatively, weights formed of high-density materials can be attached to the sole, skirt, and other parts of a golf club head. With such methods of distributing the discretionary mass, installation is critical because the golf club head endures significant loads during impact with a golf ball that can dislodge the weight. Accordingly, such weights are usually permanently attached to the golf club head and are limited to a fixed total mass, which of course, permanently fixes the golf club head's center-of-gravity and moments of inertia.

For example, FIG. 4 illustrates a cross-section of the golf club head 10 of FIG. 1. In the illustrated embodiment, in addition to the rearward mass pad 44 described previously, the forward mass pad 42 further comprises three separate sections, all of which are integrally formed into a single structure. Alternatively, the three sections may be formed separately, but placed in contact, or in close proximity to one another. While three sections are illustrated, it is understood that more or fewer sections may be formed. The first section, heel mass section 64, is positioned adjacent the heel side 26 of the golf club head 10, and comprises a first heel mass portion 66 nearest the heel side 26, having a first forward to rearward dimension. The heel mass section 64 further comprises a second heel mass portion 68 that is further from the heel side 26 than the first heel mass portion 66, and has a second forward to rearward dimension. In the illustrated embodiment, this second forward to rearward dimension is smaller than the first forward to rearward dimension, though these relative dimensions could be reversed. Further, heel mass section 64 has a vertical height that may be higher in the first heel mass portion 66 near the heel side 26 and may slope downward toward the second heel mass portion 68. Additionally, the heel mass section 64 may have one or more edges that slope downward from a first vertical height to an edge portion that makes contact with the sole 30.

Opposite the heel mass section 64 and adjacent the toe side 24 of the golf club head 10 is a second, toe mass section 84, which comprises a first toe mass portion 86 nearest the toe side 24, having a third forward to rearward dimension. In the illustrated embodiment this third forward to rearward dimension is shown as similar to the first forward to rearward dimension of the first heel mass portion 66, but these first and third forward to rearward dimensions may in some cases be different. The toe mass section 84 further comprises a second toe mass portion 88 that is further from the toe side 24 than the first toe mass portion 86, and has a fourth forward to rearward dimension. In the illustrated embodiment, this fourth forward to rearward dimension is smaller than the third forward to rearward dimension, though these relative dimensions could be reversed. In the illustrated embodiment this fourth forward to rearward dimension is shown as similar to the second forward to rearward dimension of the second heel mass portion 68, but these first and third forward to rearward dimensions may in some cases be different. Further, toe mass section 84 has a vertical height that may be higher in the first toe mass portion 86 near the toe side 24 and may slope downward toward the second toe mass portion 88. Additionally, the toe mass section 84 may have one or more edges that slope downward from a first vertical height to an edge portion that makes contact with the sole 30.

Positioned in between the heel mass section 64 and toe mass section 84 is a third, middle mass section 94, which in the illustrated embodiment has a fifth forward to rearward dimension that is smaller than any of the four forward to rearward dimensions described for the heel mass section 64 and toe mass section 84. However, in other embodiments, the middle mass section 94 could have a similar dimension to, e.g., the second toe mass portion 88 and the second heel mass portion 68. Also shown in the illustrated embodiment, the smaller forward to rearward dimension of the middle mass section 94 provides a void 96 between the heel mass section 64 and the toe mass section 84. Additionally, the middle mass section 94 in the illustrated embodiment has a smaller mass than the heel mass section 64 and toe mass section 84, providing increased perimeter weighting, which can increase the mass moment of inertia of the golf club head, particularly the moments of inertia about the CG z-axis, Izz, and the CG x-axis, Ixx. For example, splitting the forward mass pad 42 into areas of larger mass offset from a center of gravity of the club, as with heel mass section 64 and toe mass section 84, may increase the moment of inertia about the CG z-axis, Izz, and the CG x-axis, Ixx by about 10 percent, or in some instances eight percent, or in some instances six percent, or in some instances five percent, versus designs which do not implement such a split mass approach. And, generally moving mass rearward and to the perimeter of the golf club head generally may favorably increases the moment of inertia of the golf club head. The mass for the heel mass section 64 and toe mass section 84 may be similar, or alternatively, may be weighted differently, depends on the needs of the club designer. Similarly, each of the first heel mass portion 66 and the first toe mass portion 86 has a greater mass than their corresponding second heel mass portion 68 and second toe mass portion 88, again moving additional discretionary mass to the perimeter of the club, further increasing the mass moment of inertia of the golf club head, particularly the moments of inertia about the CG z-axis, Izz, and the CG x-axis, Ixx.

Figure 2:
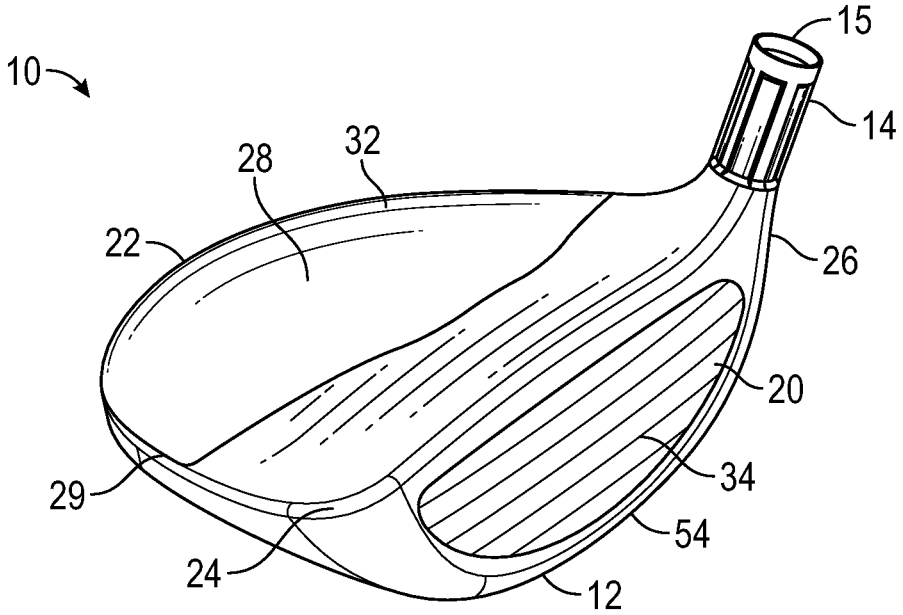
FIG. 2 is a front perspective view of the golf club head of FIG. 1.
Figure 5:
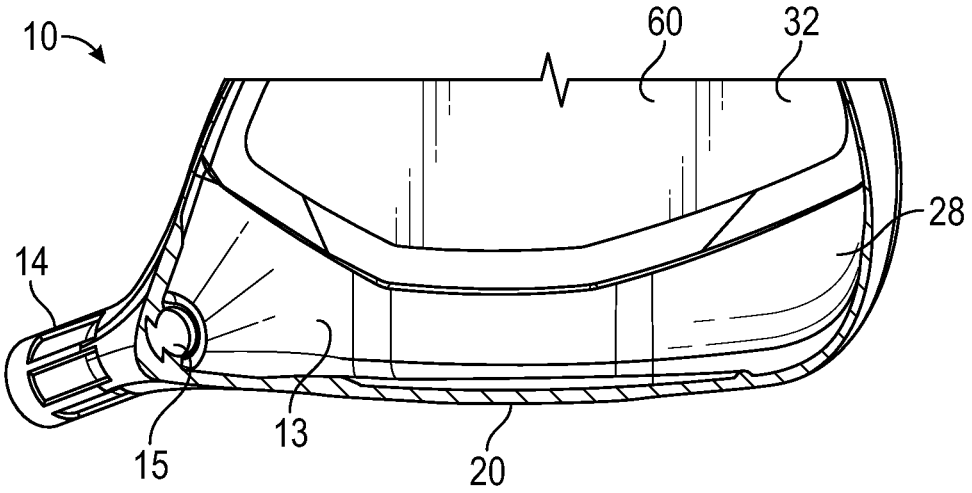
FIG. 5 is a sole-side cross-sectional view of the golf club head of FIG. 1.

As shown in FIGS. 2, 3, and 5, the golf club head 10 can optionally include a separate crown insert 32 that is secured to the body 12, such as by applying a layer of epoxy adhesive 33 or other securement means, such as bolts, rivets, snap fit, other adhesives, or other joining methods or any combination thereof, to cover a large opening 60 at the top and rear of the body, forming part of the crown 28 of the golf club head. The crown insert 32 covers a substantial portion of the crown's surface area as, for example, at least 40%, at least 60%, at least 70% or at least 80% of the crown's surface area. The crown's outer boundary generally terminates where the crown surface undergoes a significant change in radius of curvature, e.g., near where the crown transitions to the golf club head's sole 30, hosel 14, and front end 20.

As best illustrated in FIG. 7A, the crown opening 60 can be formed to have a recessed peripheral ledge or seat 62 to receive the crown insert 32, such that the crown insert is either flush with the adjacent surfaces of the body to provide a smooth seamless outer surface or, alternatively, slightly recessed below the body surfaces. The front of the crown insert 32 can join with a front portion of the crown 28 on the body to form a continuous, arched crown extend forward to the face. The crown insert 32 can comprise any suitable material (e.g., lightweight composite and/or polymeric materials) and can be attached to the body in any suitable manner, as described in more detail elsewhere herein.

A wood-type golf club head, such as golf club head 10 and the other wood-type club heads disclosed herein have a volume, typically measured in cubic-centimeters ($cm^3$) equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports.

In some embodiments, as in the case of a fairway wood (as illustrated), the golf club head may have a volume between about 100 $cm^3$ and about 300 $cm^3$, such as between about 150 $cm^3$ and about 250 $cm^3$, or between about 125 $cm^3$ and about 240 $cm^3$, and a total mass between about 125 g and about 260 g. In the case of a utility or hybrid club (analogous to the illustrated embodiments), the golf club head may have a volume between about 60 $cm^3$ and about 150 $cm^3$, and a total mass between about 125 g and about 280 g. In the case of a driver (analogous to the illustrated embodiments), any of the disclosed golf club heads can have a volume between about 300 $cm^3$ and about 600 $cm^3$, between about 350 $cm^3$ and about 600 $cm^3$, and/or between about 350 $cm^3$ and about 500 $cm^3$, and can have a total mass between about 145 g and about 260 g, such as between about 195 g and about 205 g.

Figure 8A:
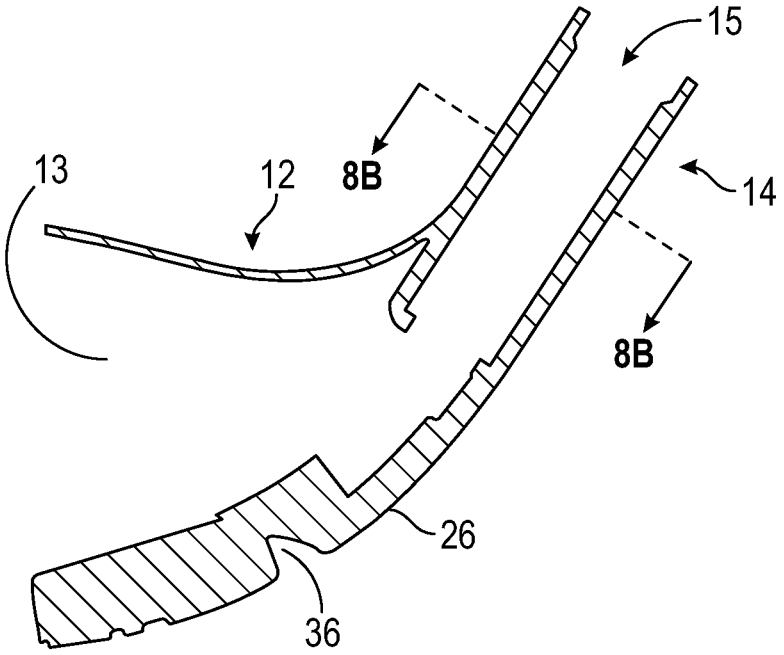
FIG. 8A is a cross-sectional view of a hosel of the golf club head of FIG. 1.
Figure 8B:
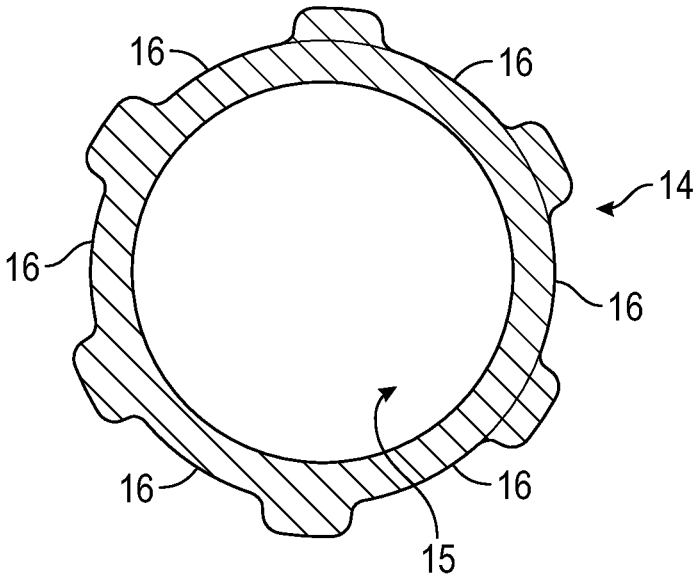
FIG. 8B is a cross-sectional view of a hosel bore of the hosel of FIG. 8A, taken along line 8B-8B in FIG. 8A.

As illustrated in FIGS. 8A and 8B, the hosel bore 15 may pass through the hosel and open up into the interior cavity 13 of the body 12. As further illustrated in FIG. 8B, the hosel 14 may have a plurality of indentations 16 around its circumference, which reduces the overall mass of the hosel 14, and thus the golf club head 10, freeing up additional discretionary mass, and also providing for greater flexibility and "give" of the golf club head 10 when affixed to a golf club shaft (not pictured).

Additionally, the thickness of the hosel may be varied to provide for additional discretionary mass, as described in U.S. patent application Ser. No. 14/981,330, the entire disclosure of which is hereby incorporated by reference.

In some of the embodiments described herein, a comparatively forgiving golf club head for a fairway wood can combine an overall golf club head height ($H_{ch}$) of less than about 46 mm and an above ground center-of-gravity location, Zup, less than about 18 mm. Some examples of the golf club head provide an above ground center-of-gravity location, Zup, less than about 17 mm, less than about 16 mm, less than about 15.5 mm, less than about 15.5 mm, less than about 15.0 mm, less than about 14.5 mm, less than about 14.0 mm, or less than about 13.5 mm.

In addition, a thin crown 28 as described above provides sufficient discretionary mass to allow the golf club head to have a volume less than about 240 $cm^3$ and/or a front to back depth (Dch) greater than about 85 mm. Without a thin crown 28, a similarly sized golf club head would either be overweight or would have an undesirably located center-of-gravity because less discretionary mass would be available to tune the CG location.

In addition, in some embodiments of a comparatively forgiving golf club head, discretionary mass can be distributed to provide a mass moment of inertia about the CG z-axis, Izz, greater than about 170 kg-$mm^2$. In some instances, the mass moment of inertia about the CG z-axis, Izz, can be greater than about 300 kg-$mm^2$, such as greater than about 320 kg-$mm^2$, greater than about 340 kg-$mm^2$, greater than about 360 kg-$mm^2$, or greater than about 375 kg-mm 2. Distribution of the discretionary mass can also provide a mass moment of inertia about the CG x-axis, Ixx, greater than about 70 kg-$mm^2$. In some instances, the mass moment of inertia about the CG x-axis, Ixx, can be greater than about 100 kg-$mm^2$, such as greater than about 150 kg-$mm^2$, greater than about 200 kg-$mm^2$, or greater than about 220 kg-$mm^2$.

Alternatively, some examples of a forgiving golf club head combine an above ground center-of-gravity location, Zup, less than about 18 mm, and a high moment of inertia about the CG z-axis, Izz.

Distribution of the discretionary mass can also provide a center of gravity for the golf club head 10 located horizontally rearward of a center of the face 20 of less than about 40 mm, such as less than about 10 to 40 mm, less than about 20 to 40 mm, less than about 20 to 30 mm, less than about 15 to 30 mm, or less than about 18 to 25 mm.

The crown insert 32, disclosed in various embodiments herein, can help overcome manufacturing challenges associated with conventional golf club heads having normal continuous crowns made of titanium or other metals, and can replace a relatively heavy component of the crown with a lighter material, freeing up discretionary mass which can be strategically allocated elsewhere within the golf club head. In certain embodiments, the crown may comprise a composite material, such as those described herein and in the incorporated disclosures, such as a composite material having a density of less than 2 grams per cubic centimeter. In still further embodiments, the material has a density of less than 1.5 grams per cubic centimeter, or a density between 1 gram per cubic centimeter and 2 grams per cubic centimeter. Providing a lighter crown further provides the golf club head with additional discretionary mass, which can be used elsewhere within the golf club head to serve the purposes of the designer. For example, with the discretionary mass, additional ribs 82 can be strategically added to the hollow interior of the golf club head and thereby improve the acoustic properties of the head. Discretionary mass in the form of ribs, mass pads or other features also can be strategically located in the interior of the golf club head to shift the effective CG fore or aft, toeward or heelward or both (apart from any further CG adjustments made possible by adjustable weight features) or to improve desirable MOI characteristics, as further described herein.

Methods of making any of the golf club heads disclosed herein, or associated golf clubs, may include one or more of the following steps:

- forming a frame having a sole opening, forming a composite laminate sole insert, injection molding a thermoplastic composite head component over the sole insert to create a sole insert unit, and joining the sole insert unit to the frame, as described in more detail in the incorporated U.S. Provisional Patent Application No. 62/440,886;
- providing a composite head component which is a weight track capable of supporting one or more slidable weights;
- forming the sole insert from a thermoplastic composite material having a matrix compatible for bonding with the weight track;
- forming the sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof, wherein the sole insert is formed from a composite material having a density of less than 2 grams per cubic centimeter. In still further embodiments, the material has a density of less than 1.5 grams per cubic centimeter, or a density between 1 gram per cubic centimeter and 2 grams per cubic centimeter and the sole insert has a thickness of from about 0.195 mm to about 0.9 mm, preferably from about 0.25 mm to about 0.75 mm, more preferably from about 0.3 mm to about 0.65 mm, even more preferably from about 0.36 mm to about 0.56 mm;
- forming both the sole insert and weight track from thermoplastic composite materials having a compatible matrix;
- forming the sole insert from a thermosetting material, coating the sole insert with a heat activated adhesive, and forming the weight track from a thermoplastic material capable of being injection molded over the sole insert after the coating step;
- forming the frame from a material selected from the group consisting of titanium, one or more titanium alloys, aluminum, one or more aluminum alloys, steel, one or more steel alloys, and any combination thereof;
- forming the frame with a crown opening, forming a crown insert from a composite laminate material, and joining the crown insert to the frame such that the crown insert overlies the crown opening;
- selecting a composite head component from the group consisting of one or more ribs to reinforce the head, one or more ribs to tune acoustic properties of the head, one or more weight ports to receive a fixed weight in a sole portion of the club head, one or more weight tracks to receive a slidable weight, and combinations thereof;
- forming the sole insert and crown insert from a continuous carbon fiber composite material;

forming the sole insert and crown insert by thermosetting using materials suitable for thermosetting, and coating the sole insert with a heat activated adhesive;

forming the frame from titanium, titanium alloy or a combination thereof and has a crown opening, and the sole insert and weight track are each formed from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and forming the frame with a crown opening, forming a crown insert from a thermoplastic composite material, and joining the crown insert to the frame such that it overlies the crown opening.

The bodies of the golf club heads disclosed herein, and optionally other components of the club heads as well, serve as frames and may be made from a variety of different types of suitable materials. In some embodiments, for example, the body and/or other head components can be made of a metal material such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The body may be formed by conventional casting, metal stamping or other known processes. The body also may be made of other metals as well as non-metals. The body can provide a framework or skeleton for the club head to strengthen the club head in areas of high stress caused by the golf ball's impact with the face, such as the transition region where the club head transitions from the face to the crown area, sole area and skirt area located between the sole and crown areas.

In some embodiments, the sole insert and/or crown insert of the club head may be made from a variety of composite materials and/or polymeric materials, such as from a thermoplastic material, preferably from a thermoplastic composite laminate material, and most preferably from a thermoplastic carbon composite laminate material. For example, the composite material may comprise an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42% to 57%) will suffice. The material weighs about 200 g/m$^2$.

Another similar exemplary material which may be used for the crown insert and/or sole insert is TEPEX® DYNALITE 208. This material also has a carbon fiber volume range of 42% to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming sole and crown inserts.

Once the crown insert and/or sole insert are formed (separately) by the thermoforming process just described, each is cooled and removed from the matched die. The sole and crown inserts are shown as having a uniform thickness, which lends itself well to the thermoforming process and ease of manufacture. However, the sole and crown inserts may have a variable thickness to strengthen select local areas of the insert by, for example, adding additional plies in select areas to enhance durability, acoustic or other properties in those areas.

As shown in FIG. 3, with regard to the crown insert 32, a crown insert and/or sole insert can have a complex three-dimensional curvature corresponding generally to the crown and sole shapes of a fairway wood-type club head and specifically to the design specifications and dimensions of the particular head designed by the manufacturer. It will be appreciated that other types of club heads, such as drivers, utility clubs (also known as hybrid clubs), rescue clubs, and the like may be manufactured using one or more of the principles, methods and materials described herein.

In an alternative embodiment, the sole insert and/or crown insert can be made by a process other than thermoforming, such as injection molding or thermosetting. In a thermoset process, the sole insert and/or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the sole (or crown) insert. Each insert is cooled and removed from its respective mold.

The carbon fiber reinforcement material for the thermoset sole/crown insert may be a carbon fiber known as "34-700" fiber, available from Grafil, Inc., of Sacramento, California, which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Exemplary epoxy resins for the prepreg plies used to form the thermoset crown and sole inserts are Newport 301 and 350 and are available from Newport Adhesives & Composites, Inc., of Irvine, California.

In one example, the prepreg sheets have a quasi-isotropic fiber reinforcement of 34-700 fiber having an areal weight of about 70 g/m$^2$ and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

Once the sole insert and crown insert are formed, they can be joined to the body in a manner that creates a strong integrated construction adapted to withstand normal stress, loading and wear and tear expected of commercial golf clubs. For example, the sole insert and crown insert each may be bonded to the frame using epoxy adhesive, with the crown insert seated in and overlying the crown opening and the sole insert seated in and overlying the sole opening. Alternative attachment methods include bolts, rivets, snap fit, adhesives, other known joining methods or any combination thereof.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-$SO_2$-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially significant polysulfones are:

a) polysulfone (PSU);

b) Polyethersulfone (PES also referred to as PESU); and c) Polyphenylene sulfoner (PPSU).

Particularly important and preferred aromatic polysulfones are those comprised of repeating units of the structure —$C_6H_4SO_2$—$C_6H_4$—O— where $C_6H_4$ represents an m- or p-phenylene structure. The polymer chain can also comprise repeating units such as —$C_6H_4$—, $C_6H_4$—O—, —$C_6H_4$— (lower-alkylene)-$C_6H_4$—O—, —$C_6H_4$—O—$C_6H_4$—O—, —$C_6H_4$—S—$C_6H_4$—O—, and other thermally stable substantially-aromatic difunctional groups known in the art of engineering thermoplastics. Also included are the so called modified polysulfones where the individual aromatic rings are further substituted in one or substituents including

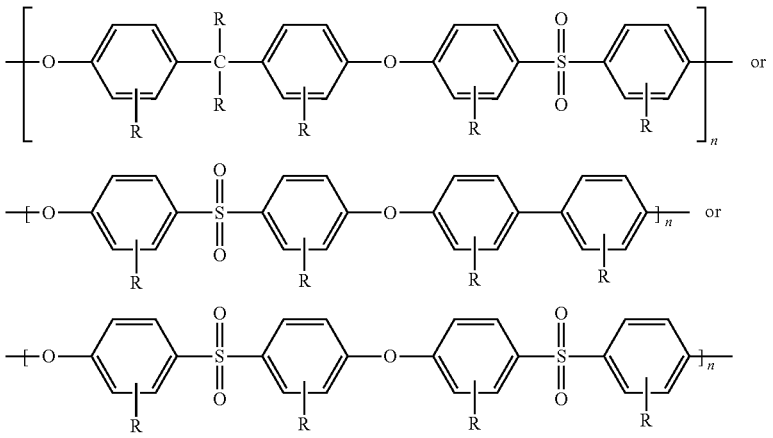

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a $C_1$-$C_{20}$ alkyl group, a $C_2$-$C_{20}$ alkenyl group, a $C_3$-$C_{20}$ cycloalkyl group, a $C_3$-$C_{20}$ cycloalkenyl group, and a $C_6$-$C_{20}$ aromatic hydrocarbon group. These hydrocarbon groups may be partly substituted by a halogen atom or atoms, or may be partly substituted by a polar group or groups other than the halogen atom or atoms. As specific examples of the $C_1$-$C_{20}$ alkyl group, there can be mentioned methyl, ethyl, propyl, isopropyl, amyl, hexyl, octyl, decyl and dodecyl groups. As specific examples of the $C_2$-$C_{20}$ alkenyl group, there can be mentioned propenyl, isopropepyl, butenyl, isobutenyl, pentenyl and hexenyl groups. As specific examples of the $C_3$-$C_{20}$ cycloalkyl group, there can be mentioned cyclopentyl and cyclohexyl groups. As specific examples of the $C_3$-$C_{20}$ cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers, include, (a) the polysulfone made by condensation polymerization of bisphenol A and 4,4'-dichlorodiphenyl sulfone in the presence of base, and having the main repeating structure

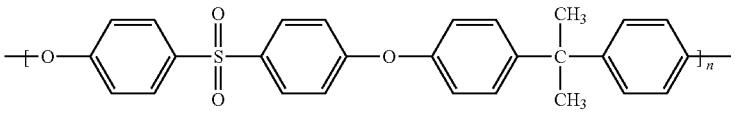

having the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

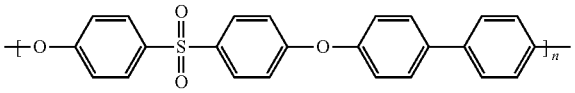

having the abbreviation PPSF and sold under the tradenames RADEL® resin; and (c) a condensation polymer made from 4,4'-dichlorodiphenyl sulfone in the presence of base and having the principle repeating structure

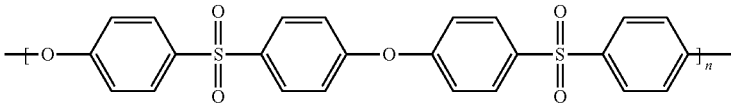

having the abbreviation PPSF and sometimes called a "polyether sulfone" and sold under the tradenames Ultrason® E, LNP™, Veradel® PESU, Sumikaexce, and VICTREX® resin, ".and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. Pat. Nos. 7,267,620; 7,140,974; and U.S. patent application Ser. Nos. 11/642,310, 11/825,138, 11/998,436, 11/895,195, 11/823,638, 12/004,386, 12/004,387, 11/960,609, 11/960,610, and 12/156,947, which are all incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

An example is a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Another example is a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Also an option is a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

The foregoing materials are well-suited for composite, polymer and insert components of the embodiments disclosed herein, as distinguished from components which preferably are made of metal or metal alloys.

Additional details regarding providing composite soles and/or crowns and crown layups are provided in U.S. patent application Ser. No. 14/789,838, the entire disclosure of which is hereby incorporated by reference.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell of the golf club head 10 may be made of a composite material, such as, for example, a carbon fiber reinforced epoxy, carbon fiber reinforced polymer, or a polymer. Additionally, U.S. patent application Ser. Nos. 10/316,453 and 10/634,023, also incorporated by reference herein in their entirety, describe golf club heads with lightweight crowns. Furthermore, U.S. patent application Ser. No. 12/974,437 (now U.S. Pat. No. 8,608,591), also incorporated by reference herein in its entirety, describes golf club heads with lightweight crowns and soles.

In some embodiments, composite materials used to construct the crown and/or should exhibit high strength and rigidity over a broad temperature range as well as good wear and abrasion behavior and be resistant to stress cracking. Such properties include (1) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039); (2) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039); (3) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790); and (4) a Flexural Modulus at room temperature of from about 0.4 Msi to about 21 Msi, from about 0.5 Msi to about 20 Msi, more preferably of from about 10 Msi to about 19 Msi (as measured by ASTM D 790).

In certain embodiments, composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. Crown and/or sole panels may be formed of plies of composite material having a fiber areal weight of between 20 $g/m^2$ and 200 $g/m^2$ and a density between about 1 g/cc and 2 g/cc. However, FAW values below 100 $g/m^2$, and more desirably 75 $g/m^2$ or less, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Some of the embodiments of the golf club head 10 discussed throughout this application may include a separate crown, sole, and/or face that may be a composite, such as, for example, a carbon fiber reinforced epoxy, carbon fiber reinforced polymer, or a polymer crown, sole, and/or face.

Alternatively, the crown, sole, and/or face may be made from a less dense material, such as, for example, Titanium or Aluminum. A portion of the crown may be cast from either steel (~7.8-8.05 g/cm$^3$) or titanium (~4.43 g/cm$^3$) while a majority of the crown may be made from a less dense material, such as for example, a material having a density of about 1.5 g/cm$^3$ or some other material having a density less than about 4.43 g/cm$^3$. In other words, the crown could be some other metal or a composite. Additionally or alternatively, the face may be welded in place rather than cast as part of the sole.

By making the crown, sole, and/or face out of a less dense material, it may allow for weight to be redistributed from the crown, sole, and/or face to other areas of the club head, such as, for example, low and forward and/or low and back. Both low and forward and low and back may be possible for club heads incorporating a front to back sliding weight track.

U.S. Pat. No. 8,163,119 discloses composite articles and methods for making composite articles, which disclosure is incorporated by reference herein in the entirety. U.S. Pat. Pub. Nos. 2015/0038262 and 2016/0001146 disclose various composite crown constructions that may be used for golf club heads, which disclosures are also incorporated by reference herein in their entireties. The techniques and layups described in U.S. Pat. No. 8,163,119, U.S. Pat. Pub. No. 2015/0038262 and U.S. Pat. Pub. No. 2016/0001146, incorporated herein by reference in their entirety, may be employed for constructing a composite crown panel, composite sole panel, composite toe panel located on the sole, and/or composite heel panel located on the sole.

U.S. Pat. No. 8,163,119 discloses the usual number of layers for a striking plate is substantial, e.g., fifty or more. However, improvements have been made in the art such that the layers may be decreased to between 30 and 50 layers. Additionally, for a panel located on the sole and/or crown the layers can be substantially decreased down to three, four, five, six, seven, or more layers.

Table 1 below provides examples of possible layups. These layups show possible crown and/or sole construction using unidirectional plies unless noted as woven plies. The construction shown is for a quasi-isotropic layup. A single layer ply has a thickness ranging from about 0.065 mm to about 0.080 mm for a standard FAW of 70 g/m$^2$ with about 36% to about 40% resin content, however the crown and/or sole panels may be formed of plies of composite material having a fiber areal weight of between 20 g/m$^2$ and 200 g/m$^2$. The thickness of each individual ply may be altered by adjusting either the FAW or the resin content, and therefore the thickness of the entire layup may be altered by adjusting these parameters.

TABLE 1

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| 0 | 90 | +45 | −45 | 0/90 woven | | | | 490-720 |
| 0 | 90 | +45 | −45 | +45 | 0/90 woven | | | 490-720 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | 45 | 0/90 woven | | | 590-720 |
| 90 | 0 | 45 | −45 | 45 | 90/0 woven | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm3 and for titanium the density is about 4.5 g/cm3. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly the main body of the golf club head 10 may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A lot of discretionary mass may be freed up by using composite material in the crown and/or sole especially when combined with thin walled titanium construction (0.4 mm to 0.9 mm) in other parts of the golf club head 10. The thin walled titanium construction increases the manufacturing difficulty and ultimately fewer parts are cast at a time. In the past, 100+ golf club heads could be cast at a single time, however due to the thinner wall construction fewer golf club heads are cast per cluster to achieve the desired combination of high yield and low material usage.

An important strategy for obtaining more discretionary mass is to reduce the wall thickness of the golf club head 10. For a typical titanium-alloy "metal-wood" club-head having a volume of 460 cm3 (i.e., a driver) and a crown area of 100 cm2, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g.

The following examples will help to illustrate the possible discretionary mass "savings" by making a composite crown rather than a titanium-alloy crown. For example, reducing the material thickness to about 0.73 mm yields an additional discretionary mass "savings" of about 25.0 g over a 0.8 mm titanium-alloy crown. For example, reducing the material thickness to about 0.73 mm yields an additional discretionary mass "savings" of about 25 g over a 0.8 mm titanium-alloy crown or 34 g over a 1.0 mm titanium-alloy crown. Additionally, a 0.6 mm composite crown yields an additional discretionary mass "savings" of about 27 g over a 0.8 mm titanium-alloy crown. Moreover, a 0.4 mm composite crown yields an additional discretionary mass "savings" of about 30 g over a 0.8 mm titanium-alloy crown. The crown can be made even thinner yet to achieve even greater weight savings, for example, about 0.32 mm thick, about 0.26 mm thick, about 0.195 mm thick. However, the crown thickness must be balanced with the overall durability of the crown during normal use and misuse. For example, an unprotected crown i.e. one without a head cover could potentially be damaged from colliding with other woods or irons in a golf bag.

For example, any of the embodiments disclosed herein may have a crown or sole insert formed of plies of composite material having a fiber areal weight of between 20 g/m$^2$ and 200 g/m$^2$, preferably between 50 g/m$^2$ and 100 g/m$^2$, the weight of the composite crown being at least 20% less than the weight of a similar sized piece formed of the metal of the body. The composite crown may be formed of at least four plies of uni-tape standard modulus graphite, the plies of uni-tape oriented at any combination of 0° (forward to rearward of the club head), +45°, −45° and 90° (heelward to toeward of the golf club head). Additionally or alternatively, the crown may include an outermost layer of a woven graphite cloth. Carbon crown panels or inserts or carbon sole panels as disclosed herein and in the incorporated applications may be utilized with any of the embodiments herein, and may have a thickness between 0.40 mm to 1.0 mm, preferably 0.40 mm to 0.80 mm, more preferably 0.40 mm to 0.65 mm, and a density between 1 gram per cubic centimeter and 2 gram per cubic centimeter, though other thicknesses and densities are also possible.

One potential embodiment of a carbon sole panel that may be utilized with any of the embodiments herein weighs between 1.0 grams and 5.0 grams, such as between 1.25 grams and 2.75 grams, such as between 3.0 grams and 4.5 grams. In other embodiments, the carbon sole panel may weigh less than 3.0 grams, such as less than 2.5 grams, such as less than 2.0 grams, such as less than 1.75 grams. The carbon sole panel may have a surface area of at least 1250 mm$^2$, 1500 mm$^2$, 1750 mm$^2$, or 2000 mm$^2$.

One potential embodiment of a carbon crown panel that may be utilized with any of the embodiments herein weighs between 3.0 grams and 8.0 grams, such as between 3.5 grams and 7.0 grams, such as between 3.5 grams and 7.0 grams. In other embodiments, the carbon crown panel may weigh less than 7.0 grams, such as less than 6.5 grams, such as less than 6.0 grams, such as less than 5.5 grams, such as less than 5.0 grams, such as less than 4.5 grams. The carbon crown panel may have a surface area of at least 3000 mm$^2$, 3500 mm$^2$, 3750 mm$^2$, 4000 mm$^2$.

FIG. 4 illustrates one embodiment of a COR feature. Similar features are shown in the other embodiments. While the illustrated embodiments may only have a COR feature, some embodiments, as in the incorporated applications, may include a COR feature and a sliding weight track, and/or a COR feature, a sliding weight track, and an adjustable lodensift/lie feature or some other combination.

As already discussed, and making reference to the embodiment illustrated in FIG. 4, the COR feature may have a certain length L (which may be measured as the distance between toeward end 40 and heelward end 38 of the front channel 36), width W (e.g., the measurement from a forward edge to a rearward edge of the front channel 36), and offset distance OS from the face 20 (e.g., the distance between the face 20 and the forward edge front channel 36, also shown in FIG. 7B as the width of the front ground contact surface 54 between the face plate 34 and the front channel 36). During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

The offset distance is highly dependent on the slot length. As slot length increases so do the stresses in the club head, as a result the offset distance must be increased to manage stress. Additionally, as slot length increases the first mode frequency is negatively impacted.

During development it was discovered that a ratio of COR feature length to the offset distance may be preferably greater than 4, and even more preferably greater than 5, and most preferably greater than 5.5. However, the ratio of COR feature length to offset distance also has an upper limit and is preferably less than 15, and even more preferably less than 14, and most preferably less than 13.5. For example, for a COR feature length of 30 mm the offset distance from the face would preferably be less than 7.5 mm, and even more preferably 6 mm or less from the face. However, the COR feature can be too close to the face in which the case the club head will fail due to high stresses and/or may have an unacceptably low first mode frequency. The tables below provide various non-limiting examples of COR feature length, offset distance from the face, and ratios of COR feature length to the offset distance.

| offset distance (OS) in mm | COR feature length (L) in mm 30 mm L/OS ratio | COR feature length (L) in mm 40 mm L/OS ratio | COR feature length (L) in mm 50 mm L/OS ratio | COR feature length (L) in mm 60 mm L/OS ratio | COR feature length (L) in mm 70 mm L/OS ratio | COR feature length (L) in mm 80 mm L/OS ratio | COR feature length (L) in mm 90 mm L/OS ratio |
|---|---|---|---|---|---|---|---|
| 4 | 7.50 | 10.00 | 12.50 | 15.00 | 17.50 | 20.00 | 22.50 |
| 4.5 | 6.67 | 8.89 | 11.11 | 13.33 | 15.56 | 17.78 | 20.00 |
| 5 | 6.00 | 8.00 | 10.00 | 12.00 | 14.00 | 16.00 | 18.00 |
| 5.5 | 5.45 | 7.27 | 9.09 | 10.91 | 12.73 | 14.55 | 16.36 |

-continued

| offset distance (OS) in mm | COR feature length (L) in mm 30 mm L/OS ratio | COR feature length (L) in mm 40 mm L/OS ratio | COR feature length (L) in mm 50 mm L/OS ratio | COR feature length (L) in mm 60 mm L/OS ratio | COR feature length (L) in mm 70 mm L/OS ratio | COR feature length (L) in mm 80 mm L/OS ratio | COR feature length (L) in mm 90 mm L/OS ratio |
|---|---|---|---|---|---|---|---|
| 6 | 5.00 | 6.67 | 8.33 | 10.00 | 11.67 | 13.33 | 15.00 |
| 6.5 | 4.62 | 6.15 | 7.69 | 9.23 | 10.77 | 12.31 | 13.85 |
| 7 | 4.29 | 5.71 | 7.14 | 8.57 | 10.00 | 11.43 | 12.86 |
| 7.5 | 4.00 | 5.33 | 6.67 | 8.00 | 9.33 | 10.67 | 12.00 |
| 8 | 3.75 | 5.00 | 6.25 | 7.50 | 8.75 | 10.00 | 11.25 |
| 8.5 | 3.53 | 4.71 | 5.88 | 7.06 | 8.24 | 9.41 | 10.59 |
| 9 | 3.33 | 4.44 | 5.56 | 6.67 | 7.78 | 8.89 | 10.00 |
| 9.5 | 3.16 | 4.21 | 5.26 | 6.32 | 7.37 | 8.42 | 9.47 |
| 10 | 3.00 | 4.00 | 5.00 | 6.00 | 7.00 | 8.00 | 9.00 |
| 10.5 | 2.86 | 3.81 | 4.76 | 5.71 | 6.67 | 7.62 | 8.57 |
| 11 | 2.73 | 3.64 | 4.55 | 5.45 | 6.36 | 7.27 | 8.18 |
| 11.5 | 2.61 | 3.48 | 4.35 | 5.22 | 6.09 | 6.96 | 7.83 |
| 12 | 2.50 | 3.33 | 4.17 | 5.00 | 5.83 | 6.67 | 7.50 |
| 12.5 | 2.40 | 3.20 | 4.00 | 4.80 | 5.60 | 6.40 | 7.20 |
| 13 | 2.31 | 3.08 | 3.85 | 4.62 | 5.38 | 6.15 | 6.92 |
| 13.5 | 2.22 | 2.96 | 3.70 | 4.44 | 5.19 | 5.93 | 6.67 |
| 14 | 2.14 | 2.86 | 3.57 | 4.29 | 5.00 | 5.71 | 6.43 |
| 14.5 | 2.07 | 2.76 | 3.45 | 4.14 | 4.83 | 5.52 | 6.21 |
| 15 | 2.00 | 2.67 | 3.33 | 4.00 | 4.67 | 5.33 | 6.00 |
| 15.5 | 1.94 | 2.58 | 3.23 | 3.87 | 4.52 | 5.16 | 5.81 |
| 16 | 1.88 | 2.50 | 3.13 | 3.75 | 4.38 | 5.00 | 5.63 |
| 16.5 | 1.82 | 2.42 | 3.03 | 3.64 | 4.24 | 4.85 | 5.45 |
| 17 | 1.76 | 2.35 | 2.94 | 3.53 | 4.12 | 4.71 | 5.29 |

As can be seen from the tables above, for a COR feature length between 30-60 mm the offset distance is preferably 4 mm or greater and 15 mm or less, more preferably 5 mm or greater and 10 mm or less, most preferably 5.5 mm or greater and 8.5 mm or less. Additionally or alternatively, for a COR feature length between 30-60 mm a ratio of COR feature length to offset distance from the face may be preferably at least 4 and at most 15, more preferably at least 5 and at most 12.5, most preferably at least 6 and at most 12.

As can be seen from the tables above, for a COR feature length between 60-90 mm the offset distance is preferably 4 mm or greater and 15 mm or less, more preferably 5 mm or greater and 13.5 mm or less, most preferably 5.5 mm or greater and 12.5 mm or less. Additionally or alternatively, for a COR feature length between 60-90 mm a ratio of COR feature length to offset distance from the face may be preferably at least 4 and at most 15, more preferably at least 5 and at most 12.5, most preferably at least 6 and at most 12.

Importantly, as COR feature length increases it is important to increase the offset distance from the face. A COR feature length of 60 mm is in between a small COR feature and a large COR feature, which is why it was included in both of the non-limiting examples of above. The ratio is important to maintain and although not all lengths of COR features are provided in the tables above a preferred offset distance range may be calculated by applying the ratio to a given COR feature length.

The sound and feel of golf club heads are vitally important to their acceptance among golfers and especially top golfers. Sound and feel is largely dictated by the club heads first mode frequency, and preferably the club head has a first mode frequency of at least 2800 Hz, such as at least 3000 Hz, such as at least 3200 Hz, such as at least 3400 Hz, such as at least 3500 Hz.

The inventors discovered during the design stage that the COR feature length greatly effects the first mode frequency. The chart below shows the first mode frequency in Hz as a function of slot or COR feature length in mm. Two different designs are shown in the chart a V5 and V6 K-N. Both designs are representative of the embodiments disclosed herein. As illustrated by the slope of the plots, for the V5 version each millimeter increase of slot length caused the first mode frequency to decreases by about 45 Hz. Similarly, for the V6 version each millimeter increase of slot length caused the first mode frequency to decreases by about 65 Hz. This information helps determine the overall slot length. Of course, the distance from the face to the slot or COR feature also plays a role in the first mode frequency. For this study the slot offset distance from the face was held constant and only slot length was varied.

In another study, the COR feature offset distance from the face was varied and the COR was measured. A COR feature length of 40 mm was used for the study, and the results will vary depending on the COR feature length. A shorter COR feature length will decrease COR while a longer COR feature length will increase COR. In other words, a shorter COR feature length needs to be closer to the face to achieve the same COR benefits as longer COR feature length. As can be seen from the data COR increases as the COR feature approaches the face. For this particular slot length of 40 mm there is almost no COR benefit beyond 12 mm from the face.

| COR feature offset distance from face in mm | COR |
|---|---|
| 6.65 | 0.816 |
| 11.65 | 0.800 |
| 15.15 | 0.793 |

The stress levels in a golf club play an important role in determining its durability. The COR feature tends to decrease stress in the face, but can enhance stress in other areas more proximate to the COR feature itself. For low face stress near the COR feature it was discovered that the COR feature offset distance drives low face stress. The inventors conducted a stress study using a COR feature length of about 70 mm. The inventors investigated increasing the sole and wall thickness by 0.3 mm to reduce low face stress by 200 MPa, however this caused the COR to decrease by 0.005 points. Next, the inventors investigated decreasing the COR feature length by 30 mm to about 40 mm to reduce low face stress by 200 MPa, however this caused the COR to decrease by 0.012 points. Finally, the inventors investigated increasing the COR feature offset distance from the face by 1 mm to reduce low face stress by 200 MPa, and this only caused the COR to decrease by 0.001 points. Accordingly, the COR feature offset distance from the face plays the biggest role in stress management and in effecting the overall COR of the club head.

Figure 11:
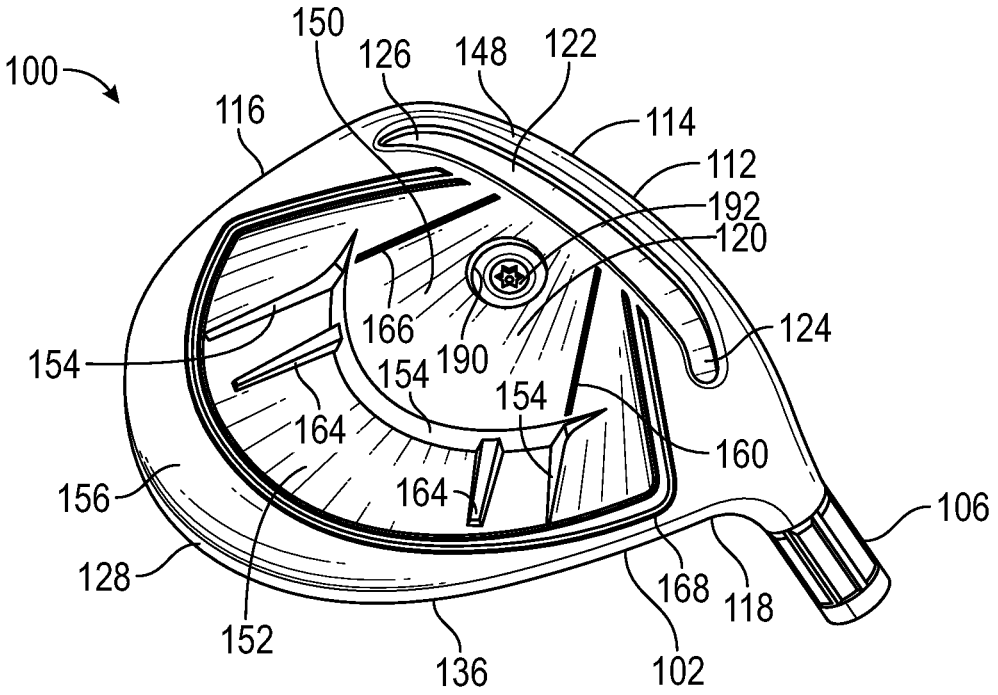
FIG. 11 is a bottom perspective view of another exemplary golf club head disclosed herein.
Figure 12:
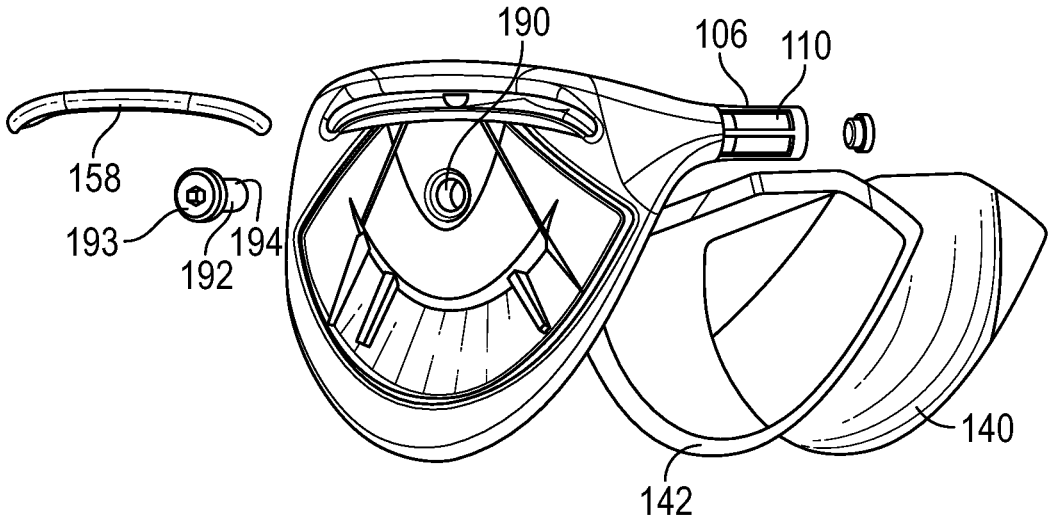
FIG. 12 is an exploded perspective view of the golf club head of FIG. 11.
Figure 14:
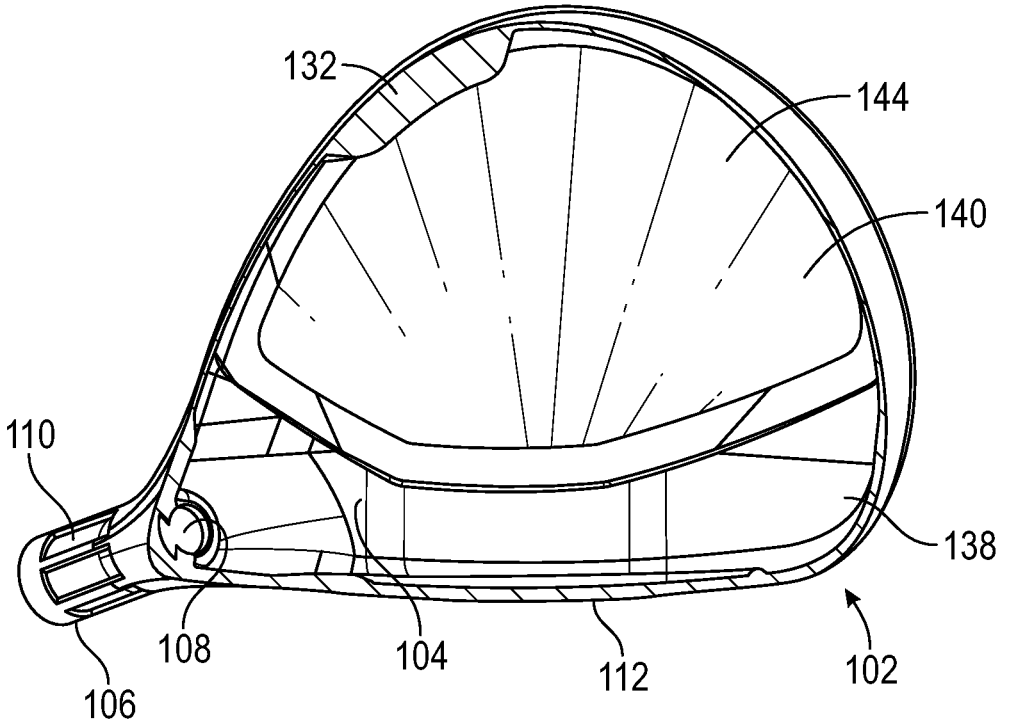
FIG. 14 is a sole-side cross-sectional view of the golf club head of FIG. 11
Figure 15:
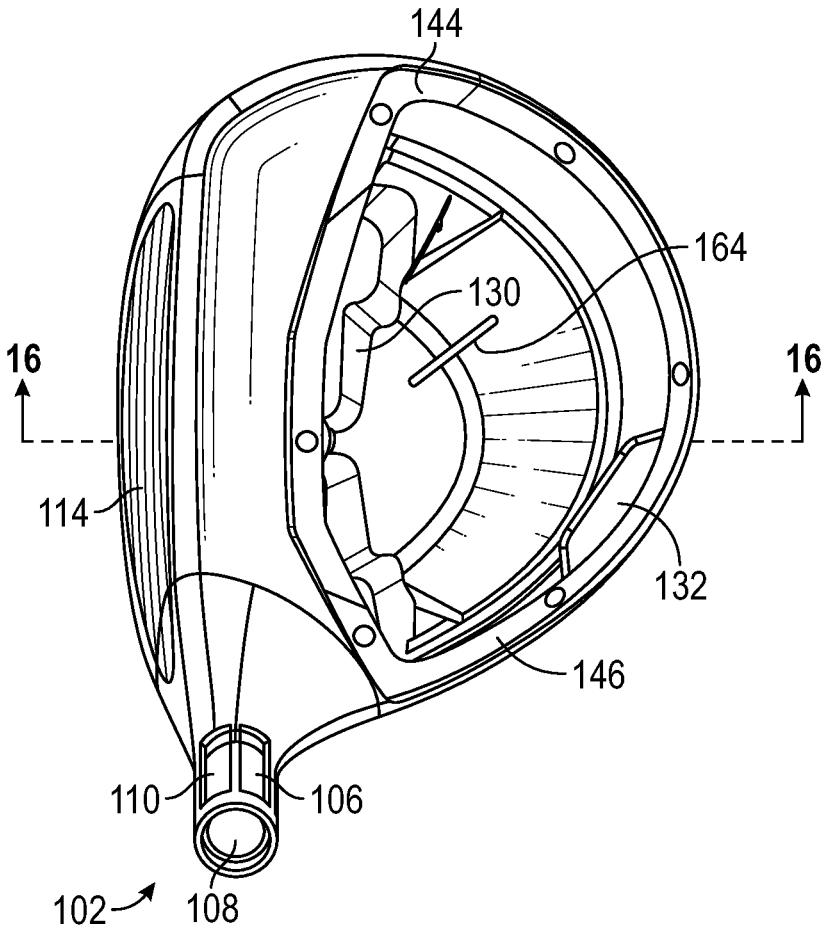
FIG. 15 is a top perspective view of the body of FIG. 13.
Figure 16:
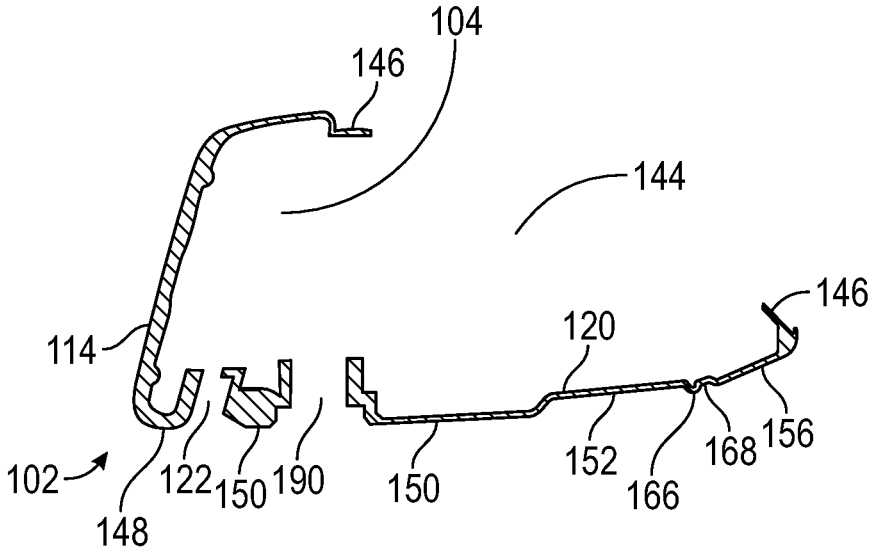
FIG. 16 is a cross-sectional view of the body of FIG. 13, taken along line 16-16 in FIG. 15.

FIGS. 11-18 illustrate another exemplary golf club head 100 that is similar to golf club head 10, and which embodies additional inventive technologies disclosed herein. The golf club head 100 comprises a body 102 (shown isolated in FIGS. 11, 13, and 15-18), a hosel 106 comprising a hosel bore 108, in which a golf club shaft may be inserted and secured to the golf club head 100, and a crown insert 140 that is attached to the body 102. The golf club head 100 defines a front end or face 112, rear end 128, toe side 116, heel side 118, lower side or sole 120, and upper side or crown 138. The front end 112 includes a face plate 114, which may be an integral part of the body 102 or a separate insert. Though not shown, the front end 112 can include a face opening to receive a face plate 114 that is attached to the body by welding, braising, soldering, screws or other fastening means. A skirt portion 136 extends around the periphery of the club head between the sole 120 and crown 138 and excluding the face plate 114. Near the face plate 114, a front channel 122 is formed in the sole 120. As illustrated in FIG. 16, the channel 122 extends into an interior cavity 104 of the golf club head 100, and so, as illustrated in FIG. 12, may be provided with a slot insert 158 to prevent dirt, grass, or other elements from entering the interior of the body 102. The front channel 122 extends in the toe-heel directions across the sole, with a heelward end 124 near the hosel 106 and an opposite toeward end 126.

Figure 13:
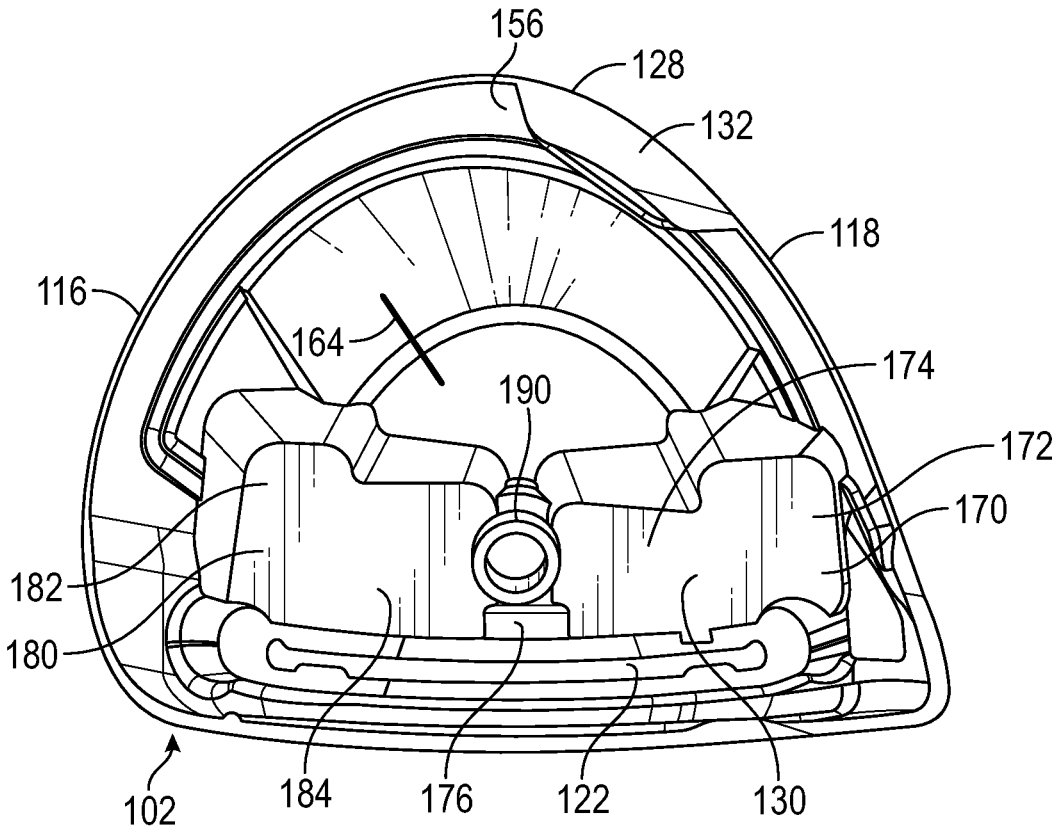
FIG. 13 is a top view of the body of the golf club head of FIG. 11.

As best illustrated in FIG. 13, a forward mass pad 130 is separated from and positioned rearward of the front channel 122, and a second, rearward mass pad 132 is positioned near a rear sole surface 156 and formed integrally with the rear end 128 of the golf club head 100. Exemplary embodiments of the structure of the forward mass pad 130 are further described herein. In the illustrated embodiment, the rearward mass pad 132 is shown as being formed on the heel side 118 of the golf club head 100, though in other embodiments, it might be situated closer to the center of the rear end 128 of the golf club head 100, or even on the toe side 116, of the golf club head 100.

The body 102 can include a front ground contact surface 148 forward of the front channel 122 adjacent the bottom of the face plate 114. The body can also have an intermediate ground contact surface, or sit pad, 150 rearward of the front channel 122. The intermediate ground contact surface 150 can have an elevation and curvature congruent with that of the front ground contact surface 148. The body 102 can further comprise a downwardly extending rear sole surface 156 that extends around the perimeter of the rear end 128. In some embodiments, the rear sole surface 156 can act as a ground contact or sit pad as well, having a curvature and elevation congruent with that of the front ground contact surface 148 and the intermediate ground contact surface 150.

The body 102 can further include a raised sole portion 152 that is recessed up from the intermediate ground contact surface 150 and from the rear sole surface 156. The raised sole portion 152 can span over any portion of the sole 120, and in the illustrated embodiment the raised sole portion 152 spans over most of the rearward portion of the sole. The sole 120 can include one or more sloped transition portions 154, including where the intermediate ground contact surface 150 transitions up to the raised sole portion 152. The sole can also include other similar sloped portions (not shown), such as around the boundary of the raised sole portion 152. In some embodiments, as illustrated, one or more cantilevered ribs or struts 164 can be included on the sole that span from the sloped transition portion 154 to the raised sole portion 152, to provide increased stiffness and rigidity to the sole.

The raised sole portion 152 can optionally include grooves, channels, ridges, or other surface features that increase its rigidity, such as ridges 166 and grooves 168, best illustrated in FIG. 16. Similarly, the intermediate ground contact surface 150 can include stiffening surface features, such as ridges 166, though grooves or other stiffening features can be substituted for the ridges.

The body 102 can also include one or more internal ribs, such as rib 164 in FIGS. 13 and 15, that are integrally formed with or attached to the inner surfaces of the body. Such ribs can vary in size, shape, location, number and stiffness, and can be used strategically to reinforce or stiffen designated areas of the body's interior and/or fine tune acoustic properties of the golf club head.

Figure 17:
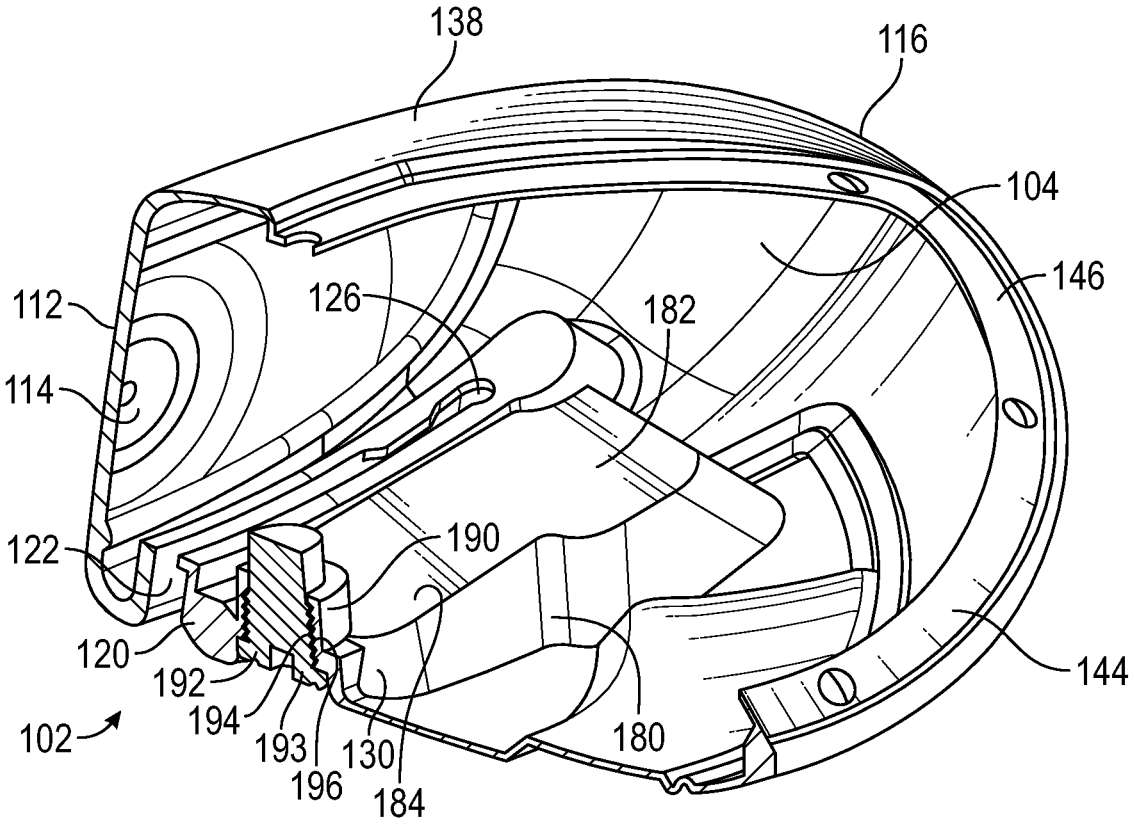
FIG. 17 is a cross-sectional view of a toe portion of the body of FIG. 13.
Figure 18:
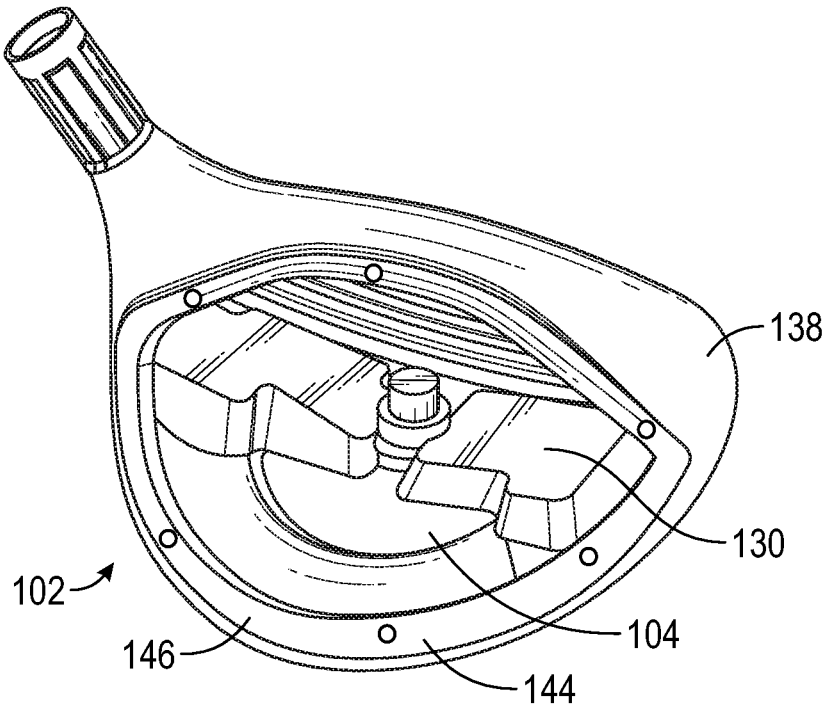
FIG. 18 is a rear perspective view of the body of FIG. 13

FIG. 13 illustrates a cross-section of the golf club head 100 of FIG. 11. In the illustrated embodiment, in addition to the rearward mass pad 132 described previously, the forward mass pad 130 further comprises three separate sections, all of which are integrally formed into a single structure. Alternatively, the three sections may be formed separately, but placed in contact, or in close proximity to one another. While three sections are illustrated, it is understood that more or fewer sections may be formed. The first section, heel mass section 170, is positioned adjacent the heel side 118 of the golf club head 100, and comprises a first heel mass portion 172 nearest the heel side 118, having a first forward to rearward dimension, and a second heel mass portion 174 that is further from the heel side 118 than the first heel mass portion 172, and has a second forward to rearward dimension. In the illustrated embodiment, this second forward to rearward dimension is smaller than the first forward to rearward dimension, though these relative dimensions could be reversed. Further, as illustrated in FIG. 17, heel mass section 170 has a vertical height that may be higher in the first heel mass portion 172 near the heel side 118 and may slope downward toward the second heel mass portion 174. Additionally, the heel mass section 170 may have one or more edges that slope downward from a first vertical height to an edge portion that makes contact with the sole 120.

Opposite the heel mass section 170 and adjacent the toe side 116 of the golf club head 100 is a second, toe mass section 180, which comprises a first toe mass portion 182 nearest the toe side 116, having a third forward to rearward dimension. In the illustrated embodiment this third forward to rearward dimension is shown as similar to the first forward to rearward dimension of the first heel mass portion 172, but these first and third forward to rearward dimensions may in some cases be different. The toe mass section 180 further comprises a second toe mass portion 184 that is further from the toe side 116 than the first toe mass portion 182, and has a fourth forward to rearward dimension. In the illustrated embodiment, this fourth forward to rearward dimension is smaller than the third forward to rearward dimension, though these relative dimensions could be reversed. In the illustrated embodiment, this fourth forward to rearward dimension is shown as similar to the second forward to rearward dimension of the second heel mass portion 174, but these first and third forward to rearward dimensions may in some cases be different. Further, as illustrated in FIG. 17, toe mass section 180 has a vertical height that may be higher in the first toe mass portion 182 near the toe side 116 and may slope downward toward the second toe mass portion 182. Additionally, the toe mass section 180 may have one or more edges that slope downward from a first vertical height to an edge portion that makes contact with the sole 120.

Positioned in between the heel mass section 170 and toe mass section 180 is a third, middle mass section 176, which in the illustrated embodiment has a fifth forward to rearward dimension that is smaller than any of the four forward to rearward dimensions described for the heel mass section 170 and toe mass section 180. However, in other embodiments, the middle mass section 176 could have a similar dimension to, e.g., the second toe mass portion 184 and the second heel mass portion 174. Also shown in the illustrated embodiment, the smaller forward to rearward dimension of the middle mass section 176 provides space to position a weight port 190 between the heel mass section 170 and the toe mass section 180, each of which may be indented slightly to provide room for the weight port 190. Additionally, the middle mass section 176 in the illustrated embodiment has a smaller mass than the heel mass section 170 and toe mass section 180, providing increased perimeter weighting, which can increase the mass moment of inertia of the golf club head, particularly the moments of inertia about the CG z-axis, Izz, and the CG x-axis, Ixx. The mass for the heel mass section 170 and toe mass section 180 may be similar, or alternatively, may be weighted differently, depends on the needs of the club designer. Similarly, each of the first heel mass portion 172 and the first toe mass portion 182 has a greater mass than their corresponding second heel mass portion 174 and second toe mass portion 184, again moving additional discretionary mass to the perimeter of the club, further increasing the mass moment of inertia of the golf club head, particularly the moments of inertia about the CG z-axis, Izz, and the CG x-axis, Ixx.

As shown in FIGS. 12 and 14, the golf club head 100 can optionally include a separate crown insert 140 that is secured to the body 102, such as by applying a layer of epoxy adhesive 142, or other securement means, such as bolts, rivets, snap fit, other adhesives, or other joining methods or any combination thereof, to cover a large opening 144 at the top and rear of the body, forming part of the crown 138 of the golf club head. The crown insert 140 covers a substantial portion of the crown's surface area as, for example, at least 40%, at least 60%, at least 70% or at least 80% of the crown's surface area. The crown's outer boundary generally terminates where the crown surface undergoes a significant change in radius of curvature, e.g., near where the crown transitions to the golf club head's sole 120, hosel 106, and front end 112.

As illustrated in FIGS. 15-18, the crown opening 144 can be formed to have a recessed peripheral ledge or seat 146 to receive the crown insert 140, such that the crown insert is either flush with the adjacent surfaces of the body to provide a smooth seamless outer surface or, alternatively, slightly recessed below the body surfaces. The front of the crown insert 140 can join with a front portion of the crown 138 on the body to form a continuous, arched crown extend forward to the face. The crown insert 140 can comprise any suitable material (e.g., lightweight composite and/or polymeric materials) and can be attached to the body in any suitable manner, as described in more detail elsewhere herein.

As illustrated in FIG. 14, the hosel bore 108 may pass through the hosel and open up into the interior cavity 104 of the body 102. Similar to the hosel in FIG. 8B, hosel 106 may have a plurality of indentations 110 around its circumference.

In addition to, or in place of the mass pads described above, certain embodiments disclosed herein, such as those in FIGS. 11-31, can be provided with one or more weight ports formed in the body that are configured to receive one or more removable weights, which can have a mass selected to positively impact various measurements of the golf club head, such as to vary Delta 1 of the golf club head to a value greater than 5 mm, greater than 10 mm, greater than 15 mm, and greater than 18.5 mm, or to further impact other measurements such as MOI, Zup, or the like.

For example, as illustrated in FIG. 11, and as further described above, weight port 190 is positioned adjacent to and is partially surrounded by forward mass pad 130. FIG. 16 illustrates a cross-sectional view that shows one example of the weight port 190 that provides the capability of a removable weight 192 to be removably engageable with the sole 120. The illustrated weight port 190 defines internal threads 196 that correspond to external threads formed on a threaded weight portion 194 of the removable weight 190, as well as a larger diameter area to retain the head portion 193 of the removable weight. The weight port 190 can have any of a number of various configurations to receive and retain any of a number of weights or weight assemblies, such as described in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein. Additionally, or alternatively, in other embodiments (not shown), weight ports may be positioned in a crown, or skirt of a golf club head.

FIGS. 12 and 13 further illustrate the weight port 190 and a removable weight 192 that may be inserted therein. Other examples of removable weights engageable with weight ports are shown in, e.g., FIGS. 19-31, which are described more fully herein. In some embodiments, as in, e.g., FIG. 11, a single weight port 190 and removable weight 192 is provided, while in others, as illustrated in, e.g., FIG. 19, a plurality of weight ports (e.g., two, three, four, five, six, or more) and engageable weights are provided. Any number of weight ports may be utilized with embodiments of this disclosure, as appropriate to suit the needs of the golf club head designer. Weights and/or weight assemblies configured for weight ports in the sole as described in this disclosure can vary in mass from about 0.5 grams to about 10 grams, from about 0.5 grams to about 20 grams, from about 2 grams to about 18 grams, or from about 2 grams to about 20 grams. Weights having other masses may also be used, if appropriate and/or desired.

Inclusion of one or more weights in the weight port(s) provides a customizable golf club head mass distribution, and corresponding mass moments of inertia and center-of-gravity locations. Adjusting the location of the weight port(s) and the mass of the weights and/or weight assemblies provides various possible locations of center-of-gravity and various possible mass moments of inertia using the same golf club head.

As discussed in more detail below, in some embodiments, a playable fairway wood golf club head can have a low, rearward center-of-gravity. Placing one or more weight ports and weights rearward in the sole as shown, for example, in FIGS. 19-31, helps desirably locate the center-of-gravity. Additionally or alternatively, a number of removable weight ports may be situated adjacent the heel and toe sections of the club, as also illustrated in FIGS. 19-31, and/or additional weight ports may be situated proximal to a front channel, as illustrated in FIGS. 11-31.

In another exemplary embodiment, shown, for example, in FIGS. 19-31, golf club head 200 comprises a body 202 defining an internal cavity 212, a hosel 218 comprising a hosel bore 220, in which a golf club shaft may be inserted and secured to the golf club head 202, as further described below, and a crown insert 216 that is attached to the body 202. The golf club head 100 defines a front end or face 222, rear end 224, toe side 226, heel side 228, lower side or sole 208, and upper side or crown 230. The front end 222 includes face plate 214, which may be an integral part of the body 202 or a separate insert. Though not shown, the front end 222 can include a face opening to receive a face plate 214 that is attached to the body by welding, braising, soldering, screws or other fastening means. A skirt portion 232 extends around the periphery of the club head between the sole 208 and crown 230 and excluding the face plate 214. Near the face plate 214, a front channel 210 is formed in the sole 120. As illustrated in FIG. 24, the channel 210 extends into an interior cavity 212 of the golf club head 100, and so may be provided with a slot insert (not shown) to prevent dirt, grass, or other elements from entering the interior of the body 202. The front channel 210 extends in the toe-heel directions across the sole, with a heelward end 234 near the hosel 218 and an opposite toeward end 236.

The body 202 can include a front ground contact surface 238 forward of the front channel 210 adjacent the bottom of the face plate 214. The body can also have an intermediate ground contact surface, or sit pad, 240 rearward of the front channel 210. The intermediate ground contact surface 240 can have an elevation and curvature congruent with that of the front ground contact surface 238. The body 202 can further comprise a downwardly extending rear sole surface 246 that extends around the perimeter of the rear end 224. In some embodiments, the rear sole surface 246 can act as a ground contact or sit pad as well, having a curvature and elevation congruent with that of the front ground contact surface 238 and the intermediate ground contact surface 240.

The body 102 can further include a raised sole portion 242 that is recessed up from the intermediate ground contact surface 240 and from the rear sole surface 246. The raised sole portion 242 can span over any portion of the sole 208, and in the illustrated embodiment the raised sole portion 242 spans over most of the forward portion of the sole. The sole 208 can include one or more sloped transition portions 244, including where the intermediate ground contact surface 240 transitions up to the raised sole portion 242, or as illustrated, where the rear sole surface 246 transitions up to the raised sole portion 242. The sole can also include other similar sloped portions (not shown), such as around the boundary of the raised sole portion 242.

In certain embodiments, a center of gravity of at least some of the weights is preferably located rearward of a midline of the golf club head along the y-axis, such as, for example, within about 40 mm of the rear end 224 of the golf club head, or within about 30 mm of the rear end 224 of the golf club head, or within about 20 mm of the rear end 224 of the golf club head.

Figure 19:
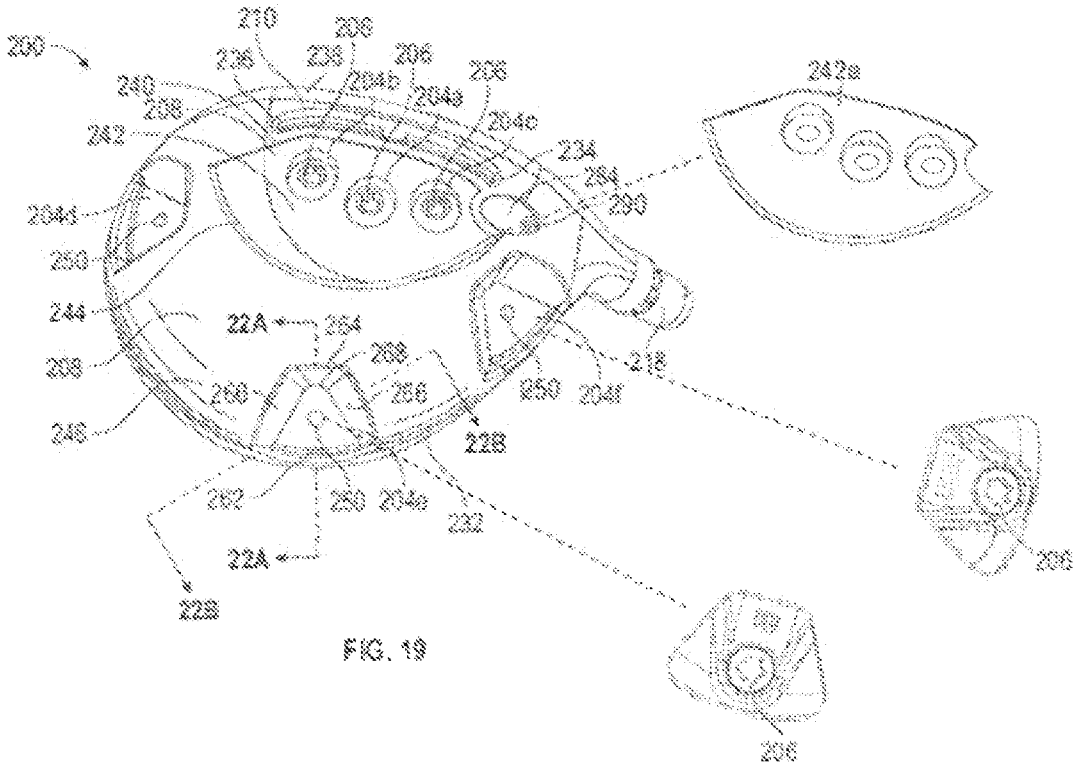
FIG. 19 is a bottom perspective view of another exemplary golf club head disclosed herein, including an enlarged view of rear weight ports including optional removable weights.

In the illustrated embodiment, as shown in FIG. 19, additional weight ports, rear toe-side weight port **204*d*, rear center weight port 204*e*, and rear heel-side weight port 204*f* are positioned around the sole 208 near the perimeter of the skirt 232. As illustrated in FIG. 19, the weight ports may be generally trapezoidal, with a broader portion positioned around the skirt 232, and extending inward to a narrower portion positioned in the sole 208 of the golf club head 200. Openings 250 may be included in the weight port in which a removable weight, e.g., removable weights 206, may be at least partially retained, such as by connecting the weights to the golf club head 200 using a threaded opening or other methods, such as those described above with regard to the removable weights installed in weight port 190**, and in the incorporated references.

Figure 22A:
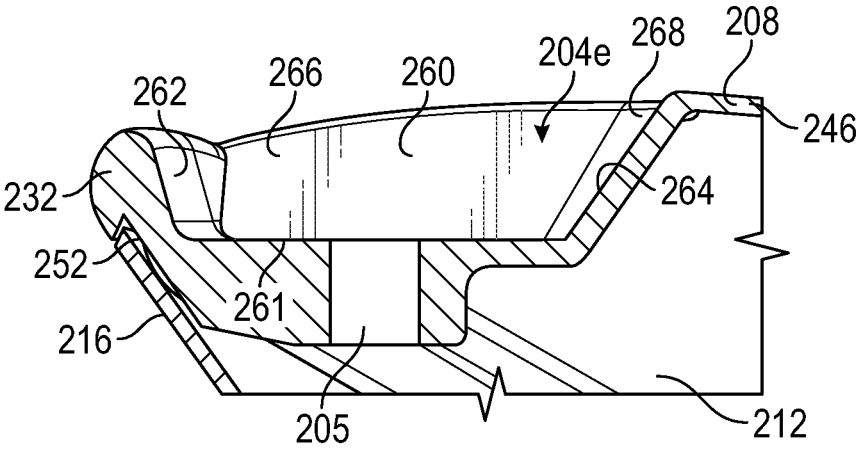
FIG. 22A is a is a cross-sectional view of a weight port in the golf club head of FIG. 19, taken along line 22A-22A in FIG. 19.
Figure 22B:
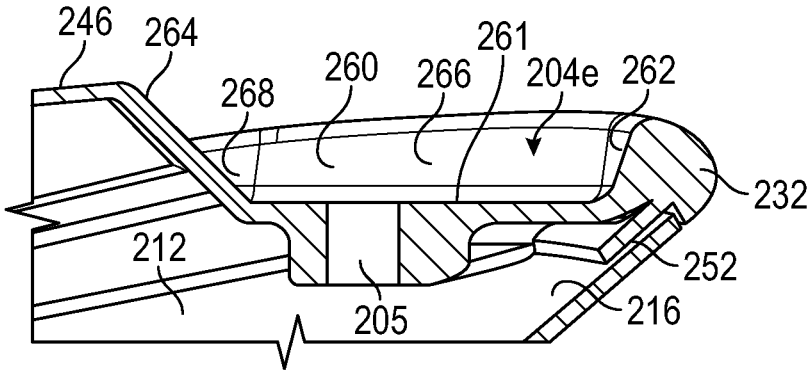
FIG. 22B is a is another cross-sectional view of a weight port in the golf club head of FIG. 19, taken along line 22B-22B in FIG. 19.

As described with reference to rear center weight port **204*e*, and as illustrated in FIGS. 22A and 22B, each of the rear weight ports is configured to at least partially retain a removable weight, which may be similar to removable weight 192, or other similar weights described above and in the incorporated applications. Rear center weight port 204*e* comprises a weight port opening 205 surrounded by a recessed retaining portion 260, which may be utilized to at least partially retain a head portion of a removable weight (not shown), which may be configured and retained similar to removable weights 192 or 206 described herein, or other similar weight heads described in the incorporated applications. Weight port opening 205 is positioned within a first raised surface 261 of the recessed retaining portion, which is substantially parallel to, and raised up from the sole 208 of the golf club head 200. On a first side of the recessed retaining portion 260 nearest the skirt 232, rear center weight port 204*e* has a peripheral wall 262, which in the illustrated embodiment extends up from the raised surface 261 and is angled slightly outward toward the skirt 232, and in the illustrated embodiment runs parallel to the skirt 232, forming the longer base of the weight port's trapezoidal shape. Opposite the peripheral wall 262 is an internal wall 264, forming the top (shorter side) of the trapezoid. The internal wall 264 extends up from the raised surface 261 at an obtuse angle towards the sole 238 of the golf club head in the rear sole surface 246. In between the peripheral wall 262 and the internal wall 264 are side walls 266 which also extend up from the raised surface 261 at opposed obtuse angles, one angling heelward, and the other angling toeward. Optionally, as in the illustrated embodiment, a transition surface 268 may be positioned between internal wall 264 and each of the side walls 266. The transition surface may form rounded edges for the top of the trapezoid adjacent the top (shorter side) of the trapezoid. Rear toe-side weight port 204*d* and rear heel-side weight port 204*f* may have a similar structure to rear center weight port 204*e*, and are shown in further detail in FIGS. 26 and 27**, respectively.

Golf club head 200 can have a center-of-gravity that is located to provide a preferable center-of-gravity projection on the face plate 214 of the golf club head. In those embodiments, as illustrated in FIG. 19, one or more front weight ports (**204*a*, 204*b*, and 204C in the illustrated embodiment) and optional removable weights 206 are placed in the sole 208 forward of a midline of the golf club head along the y-axis. A front center weight port 204*a* is located between a front toe-side weight port 204*b* and a front heel-side weight port 204*c*, and is located adjacent to and rearward of front channel 210**. As described previously, the weight ports can have any of a number of various configurations to receive and retain any of a number of weights or weight assemblies. In the embodiment shown, three weight ports are located adjacent to and rearward of the front channel.

In an alternative embodiment, raised sole portion 242 may contain a recess mass body 242*a* (see, e.g., FIG. 19) that is sized to fit within and substantially fill the footprint of the recess the raised sole portion 242 forms in the sole 208. The recess mass body may have a mass that is between 30 to 80 grams, or in some particular embodiments, a mass that is between 40 and 60 grams. In other embodiments, the recess mass body may have a smaller mass, between 20 and 40 grams. In certain embodiments, this recess mass body may be retained by, e.g., removable weights 206, which may be screws or bolts or other suitable fasteners that are inserted through the mass and into the sole 208 to at least partially retain the recess mass body within the raised sole portion 242. In still other embodiments, the recess mass body may be smaller, and may be sized and shaped so as to allow it to be slidably retained within the raised sole portion 242. For example, the recess mass body may have an internal slot that runs approximately parallel to the sloped transition portion 244 to slidably retain a single one of the removable weights 206. When tightened, the removable weight 206 retains the recess mass body in place. When removable weight 206 is loosened, the recess mass body may slide laterally in a heelward or toeward direction to adjust, for example CGx, such as to control left or right tendency of a golf swing. Additionally, projections (such as parallel ribbed projections) may be provided on the surface of raised sole portion 242 to interact with corresponding projections on a mating surface of the recess mass body to better hold it the desired position when removable weight 206 is tightened.

As discussed above, the configuration of the front channel 210 and its position near the face plate 214 allows the face plate to undergo more deformation while striking a ball than a comparable golf club head without the front channel 210, thereby increasing both COR and the speed of golf balls struck by the golf club head. As a result, the ball speed after impact is greater for the golf club head having the channel 210 than for a conventional golf club head, which results in a higher COR. The weight ports 204*a*, 204*b*, and 204*c* are separated from the front channel 210 by a distance of approximately 1 mm to about 5 mm, such as about 1.5 mm to about 3 mm. In some embodiments, a center of gravity of one or more removable weights 206 placed in the sole 208 of the golf club head is located within about 30 mm of the nearest portion of a forward edge of the sole, such as within about 20 mm of the nearest portion of the forward edge of the sole, or within about 15 mm of the nearest portion of the forward edge of the sole, or within about 10 mm of the nearest portion of the forward edge of the sole. Although other methods (e.g., using internal weights attached using epoxy or hot-melt glue) of adjusting the center-of-gravity can be used, use of a weight port and/or integrally molding a discretionary weight into the body 202 of the golf club head reduces undesirable effects on the audible tone emitted during impact with a golf ball.

Figure 23:
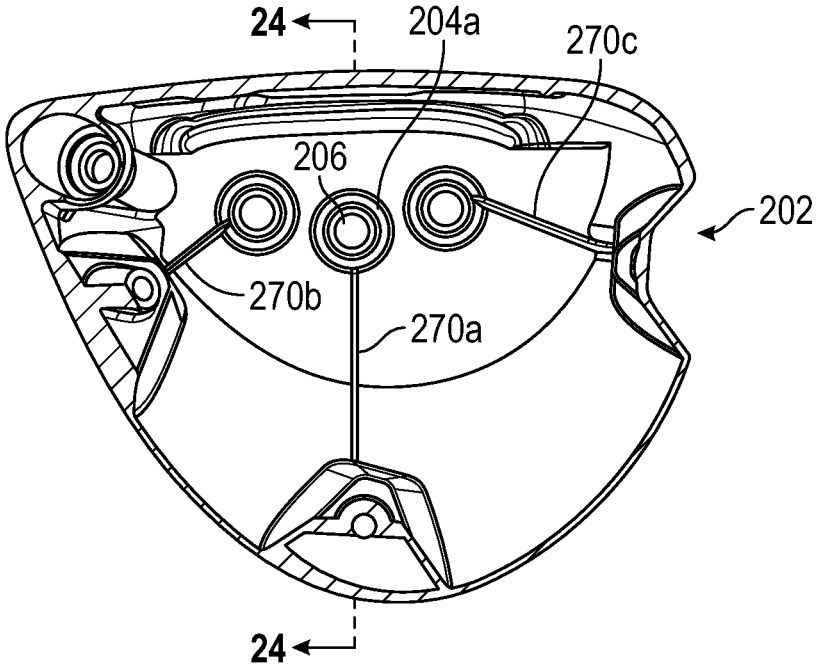
FIG. 23 is a sole-side cross-sectional view of a particular exemplary embodiment of the golf club head of FIG. 19.
Figure 24:
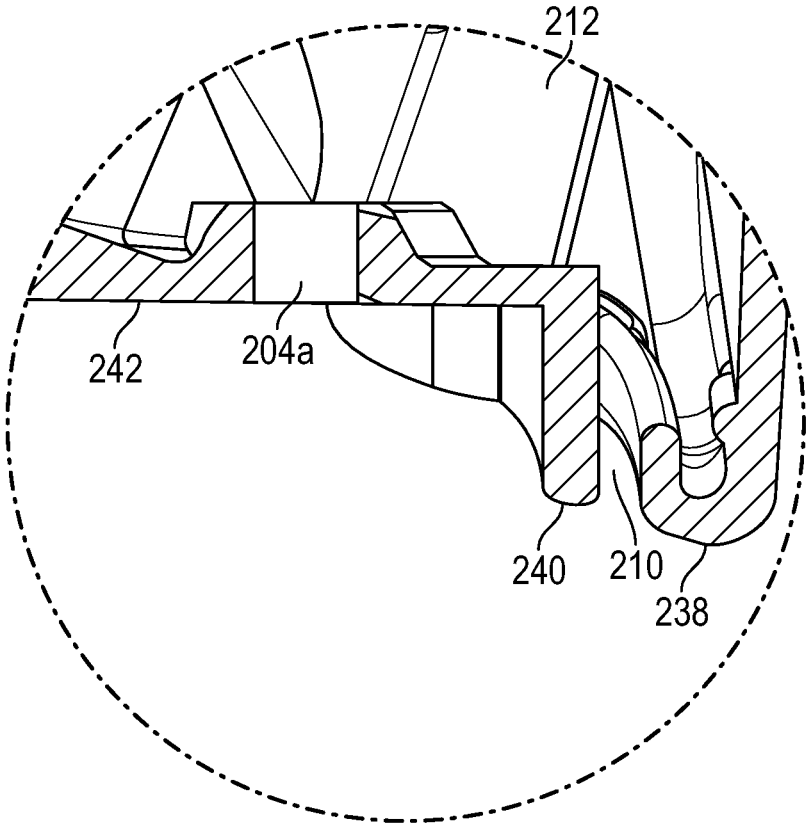
FIG. 24 is a is a cross-sectional view of another weight port in the golf club head of FIG. 19, taken along line 24-24 in FIG. 23.
Figure 25:
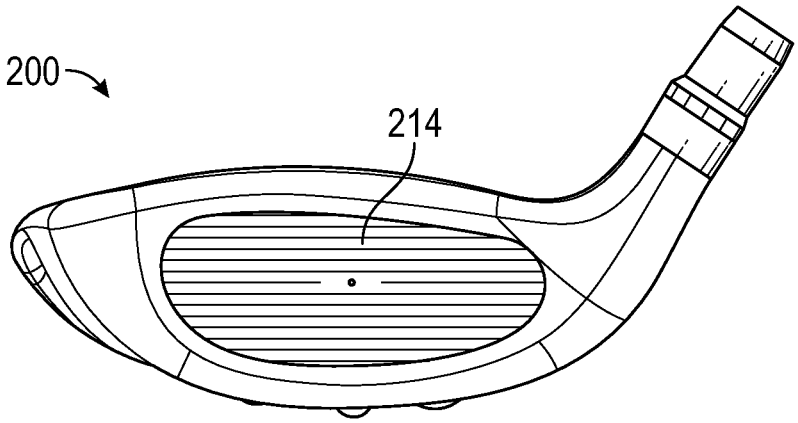
FIG. 25 is a front elevational view of the golf club head of FIG. 19.
Figure 26:
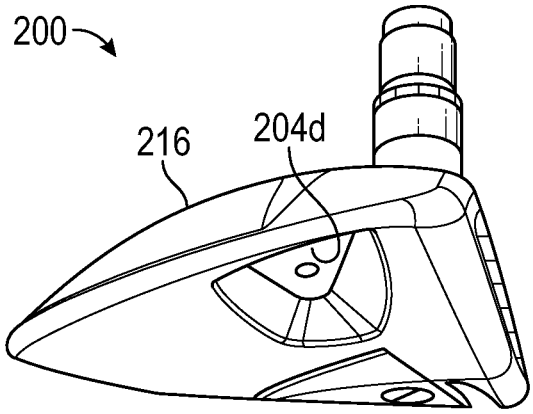
FIG. 26 is a toe-side view of the golf club head of FIG. 19.

The body 202 can also include one or more internal ribs, such as ribs 270*a*, 270*b*, and 270*c* in FIG. 23, that are integrally formed with or attached to the inner surfaces of the body. Such ribs can vary in size, shape, location, number and stiffness, and can be used strategically to reinforce or stiffen designated areas of the body's interior and/or fine tune acoustic properties of the golf club head. In the illustrated embodiment, each of ribs 270*a*, 270*b*, and 270*c* extends from one of the front weight ports—204*a*, 204*b*, and 204*c*, respectively, which are situated adjacent the front channel 210—to a corresponding one of the rear weight ports—204*e*, 204*d*, and 204*f*, respectively, which are situated around the periphery, or skirt 232, of the golf club head 202.

Figure 20:
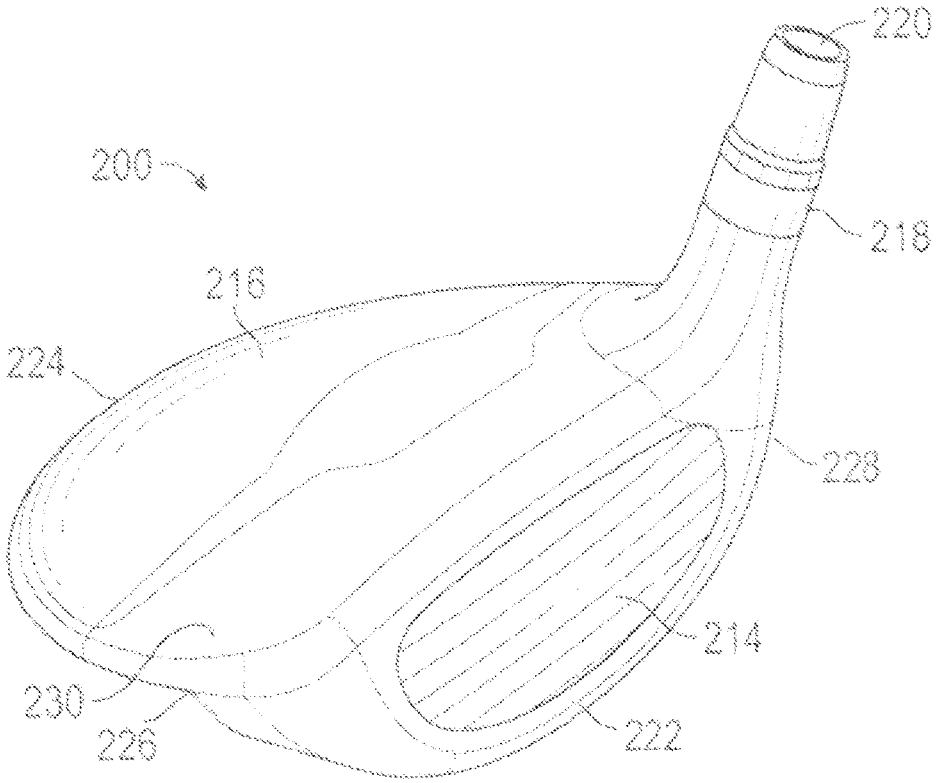
FIG. 20 is a front perspective view of the golf club head of FIG. 19.
Figure 21:
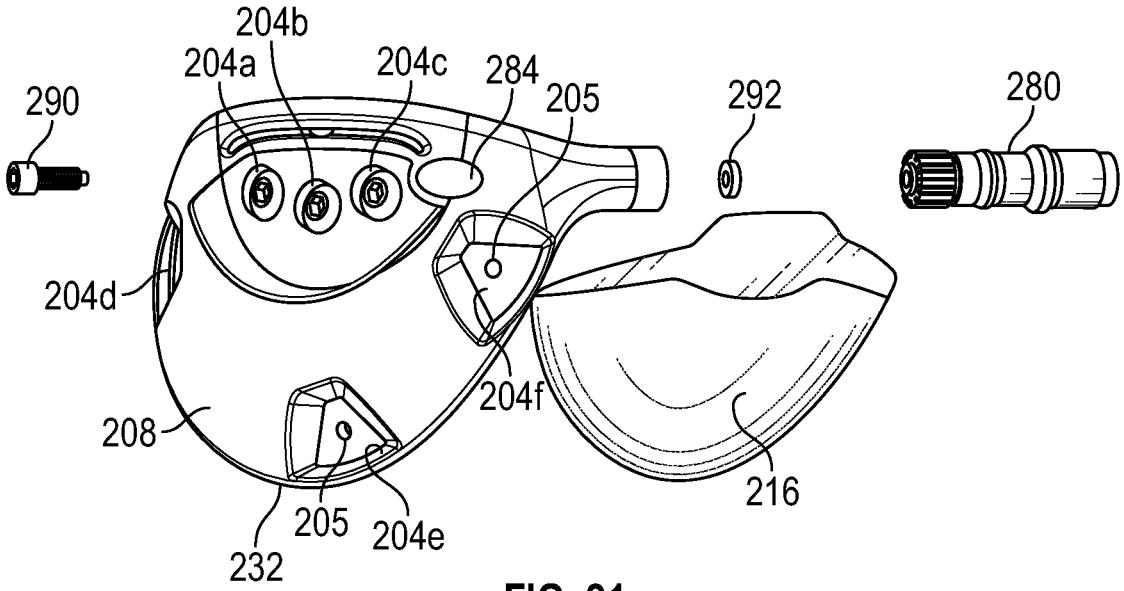
FIG. 21 is an exploded perspective view of the golf club head of FIG. 19.
Figure 27:
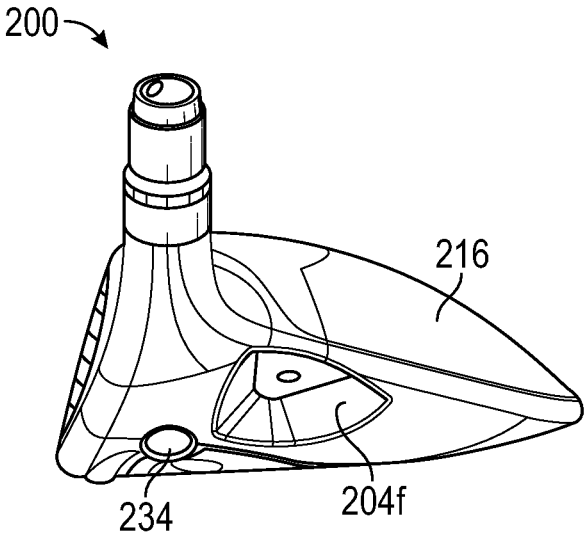
FIG. 27 is a heel-side view of the golf club head of FIG. 19.

As shown in FIGS. 20, 21, and 27, the golf club head 200 can optionally include a separate crown insert 216 that is secured to the body 202, such as by applying a layer of epoxy adhesive or other securement means, such as bolts, rivets, snap fit, other adhesives, or other joining methods or any combination thereof, to cover a large opening (not shown) at the top and rear of the body, forming part of the crown 230 of the golf club head. The crown insert 216 covers a substantial portion of the crown's surface area as, for example, at least 40%, at least 60%, at least 70% or at least 80% of the crown's surface area. The crown's outer boundary generally terminates where the crown surface undergoes a significant change in radius of curvature, e.g., near where the crown transitions to the golf club head's sole 208, hosel 218, and front end 222. As described above, and as partially shown in FIGS. 22A and 22B, the crown opening can be formed to have a recessed peripheral ledge or seat 252 to receive the crown insert 216, such that the crown insert is either flush with the adjacent surfaces of the body to provide a smooth seamless outer surface or, alternatively, slightly recessed below the body surfaces. The front of the crown insert 216 can join with a front portion of the crown 230 on the body 202 to form a continuous, arched crown extend forward to the face. The crown insert 216 can comprise any suitable material, and can be attached to the body in any suitable manner, as described in more detail herein.

The golf club head's hosel 218 further provides a shaft connection assembly that allows the shaft to be easily disconnected from the golf club head, and that provides the ability for the user to selectively adjust a and/or lie-angle of the golf club. The hosel 218 defines a hosel bore 220, which in turn is adapted to receive a hosel insert 280. The hosel bore 220 is also adapted to receive a shaft sleeve 282 mounted on the lower end portion of a shaft, as described in U.S. Pat. No. 8,303,431. A recessed port 284 is provided on the sole 208, and extends from the sole 208 into the interior cavity 212 of the body 202 toward the hosel 218, and in particular the hosel bore 220. The hosel bore 220 extends from the hosel 218 through the golf club head and opens within the recessed port 284 at the sole 208 of the golf club head 200.

The golf club head is removably attached to the shaft by shaft sleeve 282 (which is mounted to the lower end portion of a golf club shaft 300) by inserting the shaft sleeve 282 into the hosel bore 220 and a hosel insert 280 (which is mounted inside the hosel bore 220), and inserting a screw 290 (or other suitable fixation device) upwardly through the recessed port 284 and through an opening in the sole and, in the illustrated embodiment, tightening the screw 290 into a threaded opening of the shaft sleeve 282, thereby securing the golf club head to the shaft sleeve 282. A screw capturing device, such as in the form of an o-ring or washer 292, can be placed on the shaft of the screw 290 to retain the screw in place within the golf club head when the screw is loosened to permit removal of the shaft from the golf club head.

Figure 28:
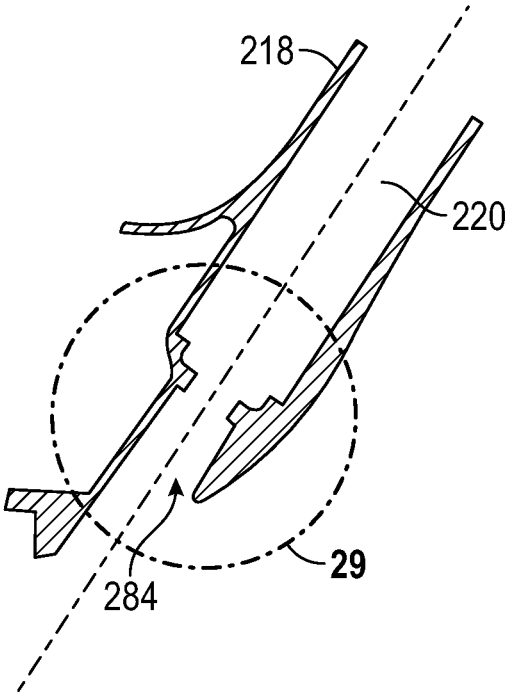
FIG. 28 is a cross-sectional view of a hosel of the golf club head of FIG. 19.
Figure 29:
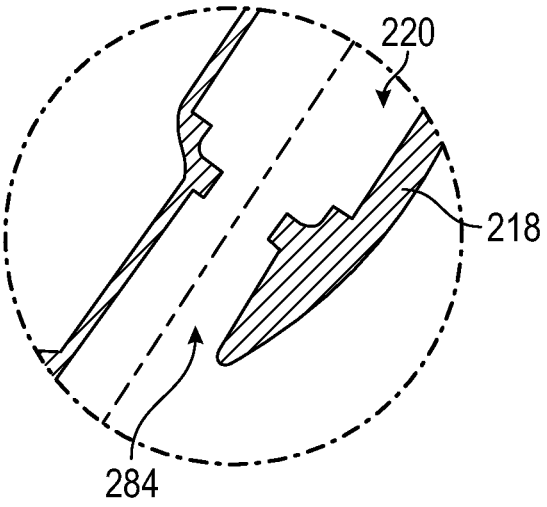
FIG. 29 is an enlarged view of a portion of the cross-sectional view of the hosel of the golf club head shown in FIG. 28.
Figure 31:
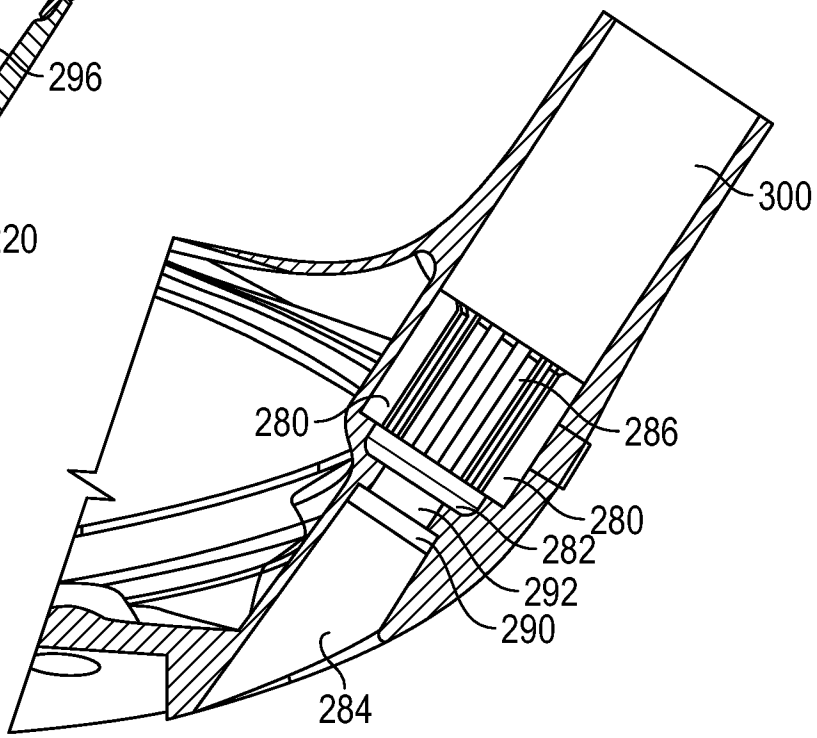
FIG. 31 is a cross-sectional view of a hosel of the golf club head of FIG. 19, including a perspective view of the hosel-shaft assembly of FIG. 30.
Figure 30:
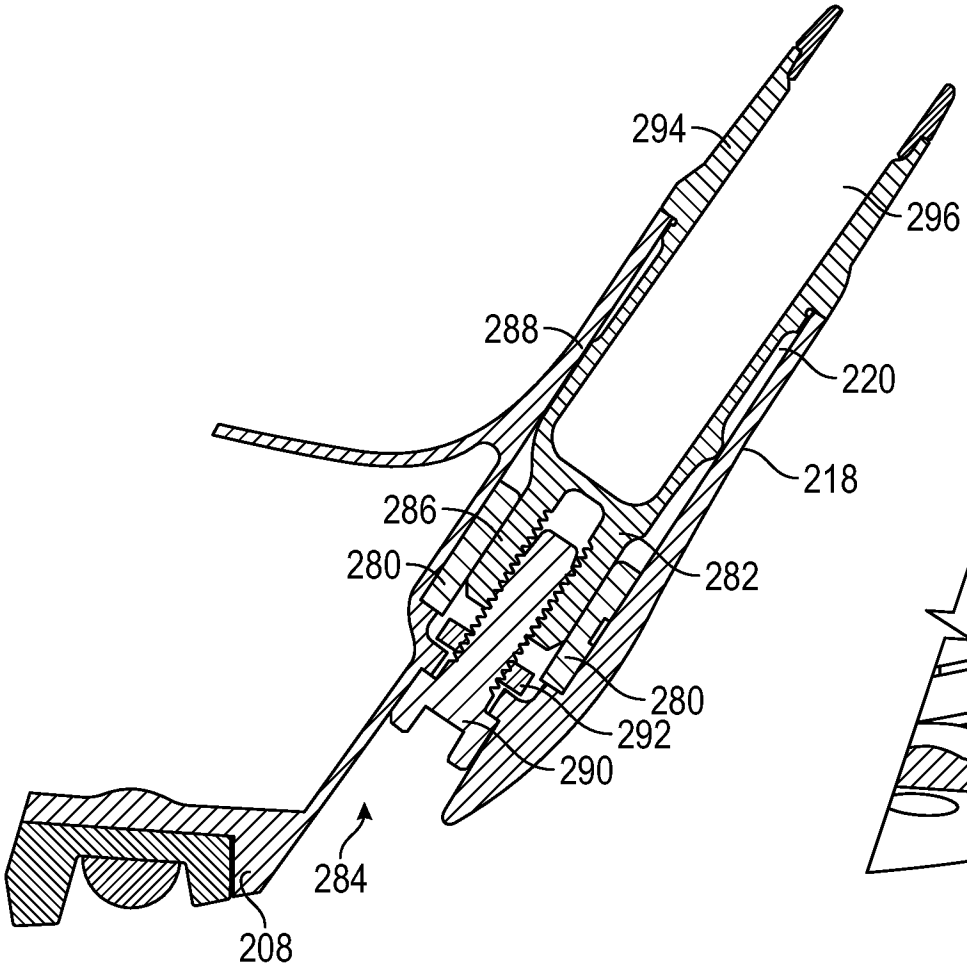
FIG. 30 is a cross-sectional view of an adjustable hosel-shaft assembly of the golf club head of FIG. 19.
Figures 32, 33:
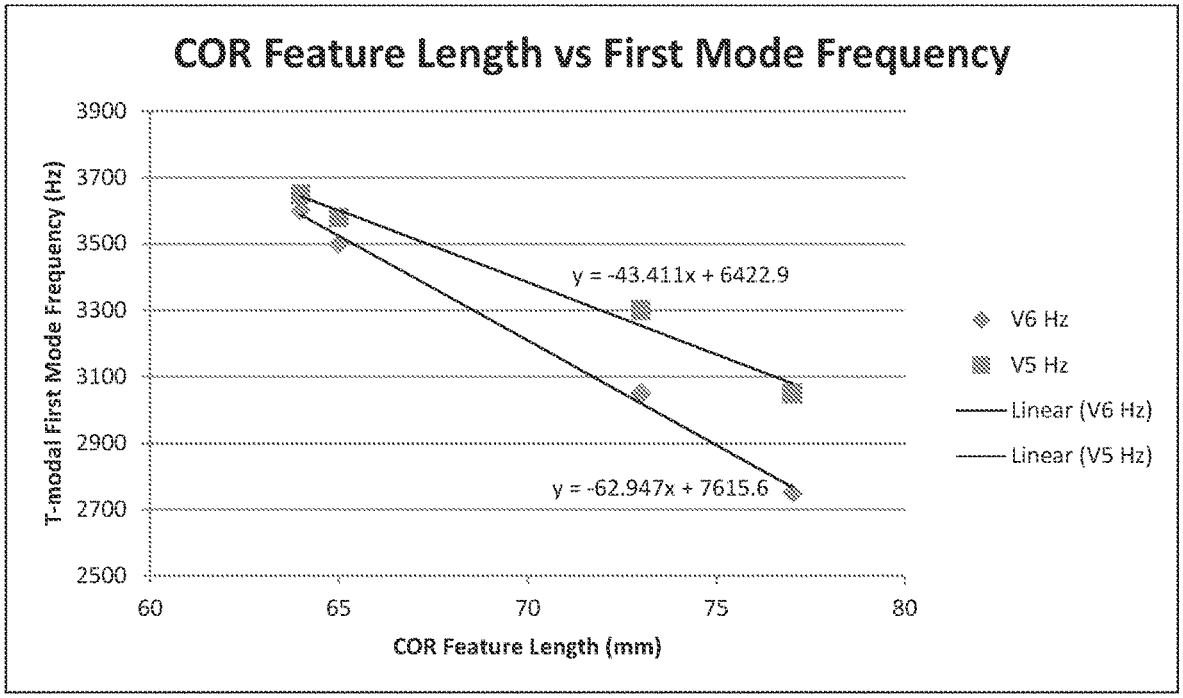
FIG. 32 is a data table depicting first mode frequency in Hz as a function of coefficient of restitution (COR) feature length in mm for two example golf club head designs.
FIG. 33 is a chart depicting the data from the table in FIG. 32.

The recessed port 284 extends from the bottom portion of the golf club head into the interior of the outer shell toward the top portion of the golf club head 200 at the location of hosel 218, as seen in FIGS. 28-30. In the embodiment shown, the mouth of the recessed port 290 in the sole 208 is generally oval-shaped, although the shape and size of the recessed port 290 may be different in alternative embodiments.

The shaft sleeve 282 has a lower portion 286 including splines that mate with mating splines of the hosel insert 282, an intermediate portion 288 and an upper head portion 294. The intermediate portion 288 and the head portion 294 define an internal bore 296 for receiving the tip end portion of the shaft 300. In the illustrated embodiment, the intermediate portion 288 of the shaft sleeve has a cylindrical external surface that is concentric with the inner cylindrical surface of the hosel bore 220. As described in more detail in U.S. Patent Application Publication No. 2010/0197424, which is hereby incorporated by reference, inserting the shaft sleeve 282 at different angular positions relative to the hosel insert 280 is effective to adjust the shaft loft and/or the lie angle. For example, the loft angle may be increased or decreased by various degrees, depending on the angular position, such as +/−1.5 degrees, +/−2.0 degrees, or +/−2.5 degrees. Other loft angle adjustments are also possible.

In the embodiment shown, because the intermediate portion 288 is concentric with the hosel bore 220, the outer surface of the intermediate portion 288 can contact the adjacent surface of the hosel bore 220, as depicted in FIG. 30. This allows easier alignment of the mating features of the assembly during installation of the shaft and further improves the manufacturing process and efficiency.

In certain embodiments, the golf club head may be attached to the shaft via a removable head-shaft connection assembly as described in more detail in U.S. Pat. No. 8,303,431, the entire contents of which are incorporated by reference herein in their entirety. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. Nos. 8,025,587, 8,235,831, 8,337,319, as well as U.S. Publication No. 2011/0312437A1, U.S. Publication No. 2012/0258818A1, U.S. Publication No. 2012/0122601A1, U.S. Publication No. 2012/0071264A1 as well as U.S. patent application Ser. No. 13/686,677, filed on Nov. 27, 2012, the entire contents of which patent, publications and application are incorporated in their entirety by reference herein.

In view of the many possible embodiments to which the principles of the disclosed technology may be applied, it should be recognized that the illustrated embodiments are only preferred examples and should not be taken as limiting the scope of the disclosed technology. Rather, the scope of the disclosure is intended to be at least as broad as the scope of the following claims. We therefore claim as our invention all that comes within the scope and spirit of these claims.

We claim:

1. A golf club head, comprising:

a golf club head body, defining an interior cavity, a top portion, and a rearward portion of the golf club head, and comprising:

a sole, defining a bottom portion of the golf club head;

a skirt portion, defining a periphery of the golf club head between the sole and a crown of the golf club head;

a face, defining a forward portion of the golf club head and extending between a heel portion of the golf club head, defined by the golf club head body, and a toe portion of the golf club head, defined by the golf club head body, wherein the rearward portion the golf club head is opposite the face;

a hosel;

a recessed port, located on a heel-side of the sole;

a hosel bore, extending through the hosel and open to the recessed port;

a crown opening and a recessed ledge along at least a forward portion of the crown opening;

wherein:

the recessed ledge receives a crown insert;

the crown insert covers the crown opening; and the crown insert:

has a density between 1 gram per cubic centimeter (g/cc) and 2 g/cc, has a surface area of at least 4,000 square millimeters, and defines at least 60% of a total surface area of the crown of the golf club head; and a mass body, attached to the golf club head body at least at a forward portion of the sole, wherein the mass body has a mass between 20 grams and 80 grams, wherein the mass body extends from a first location on the sole proximate the recessed port to a second location on the sole on the toe portion, and wherein a forward portion of the mass body is forward of a rearward portion of the recessed port.

2. The golf club head of claim 1, wherein the first location is at least as far heelward as a toewardmost portion of the recessed port.

3. The golf club head of claim 1, wherein:

the golf club head body further comprises a channel comprising a channel opening extending into the interior cavity of the golf club head;

the channel extends in a toe-heel direction across the sole, with a heelward end near the recessed port and an opposite toeward end; and the channel is positioned forward of the mass body.

4. The golf club head of claim 3, wherein the second location is at least as far toeward as a toewardmost portion of the channel opening.

5. The golf club head of claim 1, further comprising at least one removable weight, having a mass between approximately 0.5 gram and approximately 30 grams, and configured to be attached to the golf club head.

6. The golf club head of claim 1, wherein the golf club head has a balance point located on the face and the golf club head has a coefficient of restitution (COR) of no less than 0.80 as measured at the balance point on the face, and at least a portion of the golf club head body positioned forward of the mass body, toeward of the mass body, and heelward of the mass body is made of a titanium alloy.

7. The golf club head of claim 1, wherein the golf club head has an above ground center-of-gravity location, Zup, that is between 13.5 mm to 18 mm, and the golf club head has a height less than about 46 mm and a volume of between about 125 and 240 $cm^3$.

8. The golf club head of claim 7, wherein the golf club head has a moment of inertia about an x axis (Ixx) between 70 kg-$mm^2$ and 220 kg-$mm^2$ and a moment of inertia about a z axis (Izz) between 170 kg-$mm^2$ and 375 kg-$mm^2$.

9. The golf club head of claim 8, wherein Ixx is no less than 100 kg-$mm^2$.

10. The golf club head of claim 9, wherein the golf club head has a center of gravity located horizontally rearward of a center of the face of less than about 40 mm and Izz is no less than 300 kg-$mm^2$.

11. A golf club head, comprising:

a golf club head body, defining an interior cavity, a top portion, and a rearward portion of the golf club head, and comprising:

a sole, defining a bottom portion of the golf club head;

a skirt portion, defining a periphery of the golf club head between the sole and a crown of the golf club head;

a face, defining a forward portion of the golf club head and extending between a heel portion of the golf club head, defined by the golf club head body, and a toe portion of the golf club head, defined by the golf club head body, wherein the rearward portion the golf club head is opposite the face;

a hosel;

a channel comprising a channel opening extending into the interior cavity of the golf club head, and wherein the channel extends in a toe-heel direction across the sole, with a heelward end near the hosel and an opposite toeward end;

a mass body, attached to the golf club head body at least at a forward portion of the sole, wherein the mass body has a mass between 20 grams and 80 grams; and a crown opening and a recessed ledge along at least a forward portion of the crown opening;

wherein:

the recessed ledge receives a crown insert, the crown insert covers the crown opening, and the crown insert:

has a density between 1 gram per cubic centimeter (g/cc) and 2 g/cc, has a surface area of at least 4,000 square millimeters, and defines at least 60% of a total surface area of the crown of the golf club head;

the mass body extends from a first location, on a heel-side of the sole, to a second location, on a toe-side of the sole, and the second location is at least as far toeward as a toewardmost portion of the channel opening; and the channel is positioned forward of the mass body.

12. The golf club head of claim 11, wherein:

at the forward portion of the golf club head and heelward of the mass body, the golf club head body is made of a titanium alloy;

at the forward portion of the golf club head and toeward of the mass body, the golf club head body is made of a titanium alloy that is the same as or different than the titanium alloy heelward of the mass body; and the golf club head has a center of gravity that is located less than about 40 millimeters horizontally rearward of a geometric center of the face when the golf club head is in a normal address position on a horizontal plane.

13. A golf club head, comprising:

a golf club head body, defining an interior cavity, a top portion, and a rearward portion of the golf club head, and comprising:

a sole, defining a bottom portion of the golf club head;

a skirt portion, defining a periphery of the golf club head between the sole and a crown of the golf club head;

a face, defining a forward portion of the golf club head and extending between a heel portion of the golf club head, defined by the golf club head body, and a toe portion of the golf club head, defined by the golf club head body, wherein the rearward portion the golf club head is opposite the face;

a hosel;

a crown opening, at the top portion of the golf club head, and a recessed ledge along at least a forward portion of the crown opening;

a recessed port, located on a heel-side of the sole;

a hosel bore, extending through the hosel and open to the recessed port;

a mass body having a mass between 20 grams and 80 grams located at least in a forward portion of the sole and extending from a first location, on a heel-side of the sole, to a second location, on a toe-side of the sole;

a channel comprising a channel opening extending into the interior cavity of the golf club head, and wherein the channel extends in a toe-heel direction across the sole, with a heelward end near the recessed port and an opposite toeward end, and the channel is positioned forward of the mass body; and a crown insert received by the recessed ledge, and attached to the golf club head body such that the crown insert covers the crown opening; and wherein:

the first location is at least as far heelward as a toewardmost portion of the recessed port, and the second location is toeward of a toewardmost portion of the channel opening;

the crown insert:

has a density between 1 gram per cubic centimeter (g/cc) and 2 g/cc, has a surface area of at least 4,000 square millimeters, and defines a portion of the crown of the golf club head comprising at least 70% of a total surface area of the crown of the golf club head;

at the forward portion of the golf club head and heelward of the mass body, the golf club head body is made of a titanium alloy;

at the forward portion of the golf club head and toeward of the mass body, the golf club head body is made of a titanium alloy that is the same as or different than the titanium alloy heelward of the mass body; and the golf club head has a center of gravity that is located less than about 40 millimeters horizontally rearward of a geometric center of the face when the golf club head is in a normal address position on a horizontal plane.

14. The golf club head of claim 13, wherein the golf club head has an above ground center-of-gravity location, Zup, that is between 13.5 mm to 18 mm, and the golf club head has a height less than about 46 mm and a volume of between about 125 and 240cm$^3$.

15. The golf club head of claim 14, wherein the golf club head has a moment of inertia about an x axis (Ixx) between 70 kg-mm$^2$ and 220 kg-mm$^2$ and a moment of inertia about a z axis (Izz) between 170 kg-mm$^2$ and 375 kg-mm$^2$.

16. The golf club head of claim 15, wherein Ixx is no less than 100 kg-mm$^2$.

17. The golf club head of claim 16, wherein Izz is no less than 300 kg-mm$^2$.

* * * * *